US009128459B2

(12) United States Patent
Souda

(10) Patent No.: US 9,128,459 B2
(45) Date of Patent: Sep. 8, 2015

(54) IMAGE FORMING APPARATUS INCLUDING HOLDER FOR HOLDING PHOTOSENSITIVE DRUMS

(71) Applicant: Makoto Souda, Nagoya (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 13/933,793

(22) Filed: Jul. 2, 2013

(65) Prior Publication Data

US 2014/0010569 A1 Jan. 9, 2014

(30) Foreign Application Priority Data

Jul. 3, 2012 (JP) ..... 2012-149221

(51) Int. Cl.
*G03G 21/18* (2006.01)
*G03G 21/16* (2006.01)

(52) U.S. Cl.
CPC ..... *G03G 21/1839* (2013.01); *G03G 21/1619* (2013.01); *G03G 2215/0141* (2013.01); *G03G 2221/1684* (2013.01)

(58) Field of Classification Search
CPC ..... G03G 21/1619; G03G 21/1623; G03G 21/1647; G03G 21/1839; G03G 21/1853; G03G 2221/1684
USPC ..... 399/107, 110, 111; 347/152, 263
See application file for complete search history.

(56) References Cited

U.S. PATENT DOCUMENTS

| | | | |
|---|---|---|---|
| 6,477,346 | B1 | 11/2002 | Yahagi |
| 7,783,226 | B2 | 8/2010 | Tomatsu |
| 7,835,666 | B2 | 11/2010 | Kim et al. |
| 7,885,554 | B2 | 2/2011 | Shirokoshi et al. |
| 7,894,743 | B2 | 2/2011 | Tomatsu |

(Continued)

FOREIGN PATENT DOCUMENTS

| | | | |
|---|---|---|---|
| CN | 101609272 | A | 12/2009 |
| CN | 101609296 | A | 12/2009 |

(Continued)

OTHER PUBLICATIONS

Co-pending U.S. Appl. No. 13/933,839, filed Jul. 2, 2013.

(Continued)

*Primary Examiner* — David Gray
*Assistant Examiner* — Laura Roth
(74) *Attorney, Agent, or Firm* — Banner & Witcoff, Ltd.

(57) ABSTRACT

An image forming apparatus includes a main body including a metal frame, and a holder configured to hold a plurality of photosensitive drums arranged in an arrangement direction. The metal frame includes a main body portion, a first extension portion and a second extension portion. The main body portion extends in the arrangement direction and is disposed in a position not overlapping the photosensitive drums in an axial direction of the photosensitive drums, and further has a first end portion and a second end portion opposite to the first end portion in the arrangement direction. The first extension portion and the second extension portion extend from the first end portion and the second end portion of the main body portion, respectively, in a direction perpendicular to the arrangement direction and parallel to a side of the holder in a first dimension, the side of the holder being parallel to the arrangement direction in a second dimension.

20 Claims, 14 Drawing Sheets

(56) References Cited

U.S. PATENT DOCUMENTS

| | | | |
|---|---|---|---|
| 8,145,096 | B2 | 3/2012 | Kawanami et al. |
| 8,160,472 | B2 | 4/2012 | Tomatsu |
| 8,175,491 | B2 | 5/2012 | Tomatsu et al. |
| 2007/0147885 | A1 | 6/2007 | Okabe et al. |
| 2007/0160380 | A1 | 7/2007 | Imaizumi et al. |
| 2007/0160382 | A1 | 7/2007 | Tomatsu |
| 2008/0002341 | A1 | 1/2008 | Tomatsu |
| 2008/0181658 | A1 | 7/2008 | Okabe |
| 2009/0092412 | A1 | 4/2009 | Kei |
| 2009/0129812 | A1 | 5/2009 | Kawanami et al. |
| 2009/0317125 | A1 | 12/2009 | Tomatsu |
| 2009/0317126 | A1 | 12/2009 | Tomatsu |
| 2010/0014887 | A1 | 1/2010 | Tomatsu et al. |
| 2010/0166453 | A1 | 7/2010 | Okabe |
| 2010/0166457 | A1 | 7/2010 | Hashimoto |
| 2010/0329757 | A1 | 12/2010 | Souda |
| 2012/0008983 | A1 | 1/2012 | Okabe et al. |
| 2012/0251163 | A1 | 10/2012 | Tomatsu et al. |
| 2013/0004198 | A1 | 1/2013 | Tomatsu |
| 2013/0004199 | A1 | 1/2013 | Souda et al. |

FOREIGN PATENT DOCUMENTS

| | | | |
|---|---|---|---|
| CN | 102736463 | A | 10/2012 |
| JP | 2006-078544 | A | 3/2006 |
| JP | 2007148142 | A | 6/2007 |
| JP | 2007-178657 | A | 7/2007 |
| JP | 2008-009262 | A | 1/2008 |
| JP | 2009-092914 | A | 4/2009 |
| JP | 2009-128506 | A | 6/2009 |
| JP | 2010-002626 | A | 1/2010 |
| JP | 2010-002627 | A | 1/2010 |
| JP | 2010026152 | A | 2/2010 |
| JP | 2010-156790 | A | 7/2010 |
| JP | 2010-156791 | A | 7/2010 |
| JP | 2012-048025 | A | 3/2012 |
| JP | 2012-211940 | A | 11/2012 |
| JP | 2013-015588 | A | 1/2013 |
| JP | 2013-015589 | A | 1/2013 |

OTHER PUBLICATIONS

Jul. 31, 2014—(US) Non-Final Office Action—U.S. Appl. No. 13/933,839.

May 15, 2015—(CN) Notification of First Office Action—App 201310277198.3—Eng Tran.

TOP
BOTTOM
FRONT
REAR 123
360
122
124

200(2)
210
300
340
B
360
341
100(6)
250
B1
L
400
61
330(310)
320
X
350
351
(352)

IMAGE FORMING APPARATUS INCLUDING HOLDER FOR HOLDING PHOTOSENSITIVE DRUMS

CROSS REFERENCE TO RELATED APPLICATION

This application claims priority from Japanese Patent Application No. 2012-149221, filed on Jul. 3, 2012, which is incorporated herein by reference in its entirety.

FIELD

Aspects of the disclosure relate to an image forming apparatus including a holder configured to hold a plurality of photosensitive drums arranged therein.

BACKGROUND

Generally, a known image forming apparatus includes a holder holding a plurality of photosensitive drums, and a pair of left and right metal frames each having a positioning portion for positioning the holder relative to a main body. In the known image forming apparatus, the holder has side plates, a front beam, and a rear beam. A positioning shaft is provided at a front end portion of the holder. A rear end portion of the holder contains notch portions. The positioning shaft is engaged in recessed portions formed at front ends of the left and right metal frames of the main body and the notch portions are engaged with a reference axial member fixed between the left and right metal frames of the main body such that the holder is positioned relative to the apparatus body. The positioning portion is provided on each metal frame having small dimensional change due to a change in temperature, improving the positional accuracy of the holder relative to the main body.

SUMMARY

However, the metal frames are big in size and heavy in weight because they are provided to entirely cover the side surfaces of the holder. In addition, the metal frames need drilling to mount gears and couplings for inputting a drive force to the photosensitive drums and electrodes for applying bias and grounding, which undergoes complication in structure of the metal frames and restricts degrees of freedom in structure for a driving system and in arrangement of the electrodes.

Illustrative aspects of the disclosure provide an image forming apparatus configured to achieve weight reduction and improve degrees of freedom in structure for a driving system and in arrangement of electrodes.

According to an aspect of the disclosure, an image forming apparatus includes a main body and a holder. The main body includes a metal frame. The holder is configured to hold a plurality of photosensitive drums arranged in an arrangement direction. The holder is configured to move in the arrangement direction and be mounted in the main body. When the holder is mounted in the main body, the metal frame is disposed outside the holder. The metal frame includes a main body portion, a first extension portion, and a second extension portion. The main body portion extends in the arrangement direction and is disposed in a position not overlapping the photosensitive drums in an axial direction of the photosensitive drums. The main body portion further has a first end portion and a second end portion opposite to the first end portion in the arrangement direction. The first extension portion extends from the first end portion of the main body portion in a first dimension perpendicular to the arrangement direction and parallel to a side of the holder, the side of the holder being parallel to the arrangement direction in a second dimension. The second extension portion extends from the second end portion of the main body portion in the direction perpendicular to the arrangement direction and parallel to the side of the holder in the first dimension, the side of the holder being parallel to the arrangement direction in the second dimension. The first extension portion includes a first positioning portion configured to receive a coupling member that is configured to contact the holder to position the holder in the arrangement direction and in the direction perpendicular to the arrangement direction and parallel to the side of the holder in the first dimension, the side of the holder being parallel to the arrangement direction in the second dimension. The second extension portion includes a second positioning portion configured to receive the holder to position the holder in the direction perpendicular to the arrangement direction and parallel to the side of the holder in the first dimension, the side of the holder being parallel to the arrangement direction in the second dimension.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a color laser printer 1, as an example of an image forming apparatus, will be described in detail.

In the following description, orientations or sides of the color laser printer 1 will be identified based on the color laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
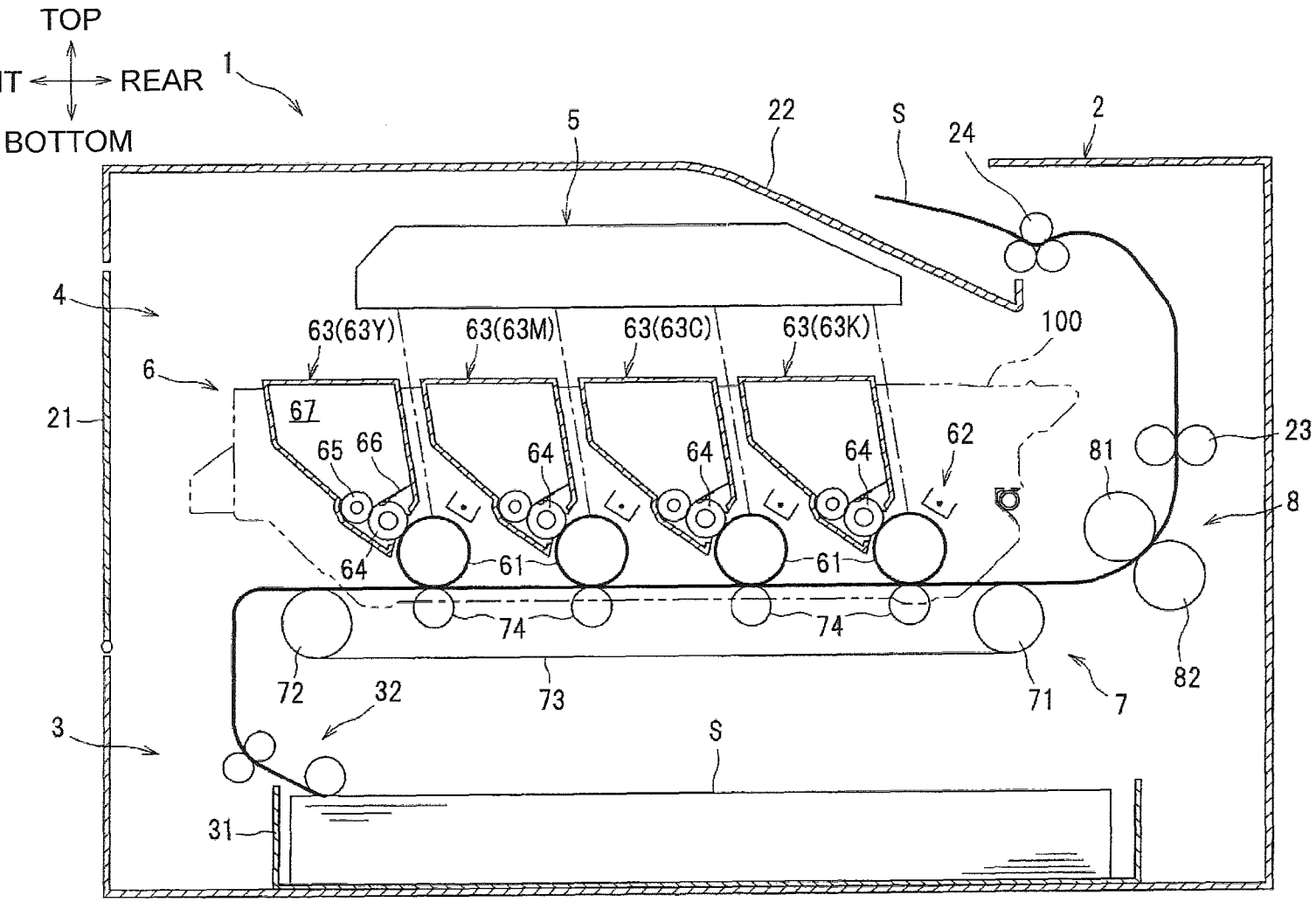
FIG. 1 is a sectional view of an illustrative image forming apparatus, e.g. a color laser printer, according to an embodiment of the disclosure.

As shown in FIG. 1, the color laser printer 1 includes a main casing 2 as an example of a main body, a sheet feed portion 3 configured to feed a sheet S, and an image forming portion 4 configured to form an image on the sheet S fed thereto. The image forming portion 4 mainly includes a light exposure unit 5, a process unit 6, a transfer unit 7 and a fixing unit 8.

The sheet feed portion 3 is disposed in a lower portion of the main casing 2, and mainly includes a sheet tray 31 configured to accommodate sheets S therein, and a sheet feeding mechanism 32 configured to feed a sheet S from the sheet tray 31 to the image forming portion 4. The sheets S in the sheet tray 31 are singly fed to the image forming portion 4 by the sheet feeding mechanism 32.

The light exposure device 5 is disposed in an upper portion of the main casing 2 and includes plural laser light sources, a polygon mirror, plural lenses, and plural reflecting mirrors, which are not shown. Laser light emitted from the laser light sources based on image data is reflected at the polygon mirror and the reflecting mirrors, passes through the lenses, and irradiates a surface of each photosensitive drum 61 as shown by a chain line.

The process unit 6 is disposed between the sheet tray 31 and the light exposure unit 5, and mainly includes a holder 100, four photosensitive drums 61 arranged along the front-rear direction, and chargers 62 and developing cartridges 63 corresponding to the photosensitive drums 61.

Each of the developing cartridges 63 includes a developing roller 64, a supply roller 65, a layer thickness regulating blade 66, and a toner storing portion 67 configured to store toner. In this embodiment, the developing cartridges 63 includes developing cartridges 63Y, 63M, 63C and 63K storing yellow toner, magenta toner, cyan toner and black toner respectively, which are arranged in this order from the front side.

The transfer unit 7 is disposed between the sheet tray 31 and the process unit 6, and mainly includes a drive roller 71, a driven roller 72, a conveyor belt 73, and four transfer rollers 74. The conveyor belt 73 is endless, extends between the drive roller 71 and the driven roller 72, and contacts the photosensitive drums 61 at its outer surface. The transfer rollers 74 are disposed inside the conveyor belt 73 such that the conveyor belt 73 is sandwiched between the transfer rollers 74 and the photosensitive drums 61.

The fixing unit 8 is disposed at the rear of the process unit 6 and the transfer unit 7, and mainly includes a pressure roller 81 and a pressure roller 82 disposed opposite to the heat roller 81 and configured to press the heat roller 81.

In the image forming portion 4, the surface of each photosensitive drum 61 is uniformly charged by a corresponding charger 62, and subsequently exposed to laser light from the light exposure unit 5 by high speed scanning. Thus, a potential in an exposed area of each photosensitive drum 51 drops, and an electrostatic latent image based on image data is formed on the surface of each photosensitive drum 61. Then, toner stored in the toner storing portion 67 is supplied to the developing roller 64 via the supply roller 65, enters in between the developing roller 64 and the layer thickness regulating blade 66, and is carried on the developing roller 64 as a thin layer having a fixed thickness.

The toner carried on the developing roller 64 is supplied onto the electrostatic latent image formed on the corresponding photosensitive drum 61, thereby the electrostatic latent image is developed into a visible image such that a toner image is formed on the photosensitive drum 61. Then, when a sheet S is supplied from the sheet supply portion 3 and fed in between each of the photosensitive drums 61 and the conveyor belt 73, the toner images carried on the surfaces of the photosensitive drums 61 are sequentially transferred onto the sheet S.

The sheet S having the toner images transferred thereto passes between the heat roller 81 and the pressure roller 82 and the toner images transferred onto the sheet S are thermally fixed. The sheet S having the toner images thermally fixed is ejected outside from the main casing 2 by feed rollers 23 and ejection rollers 24, which are disposed in the main casing 2, and received onto an ejection tray 22.

Figure 2:
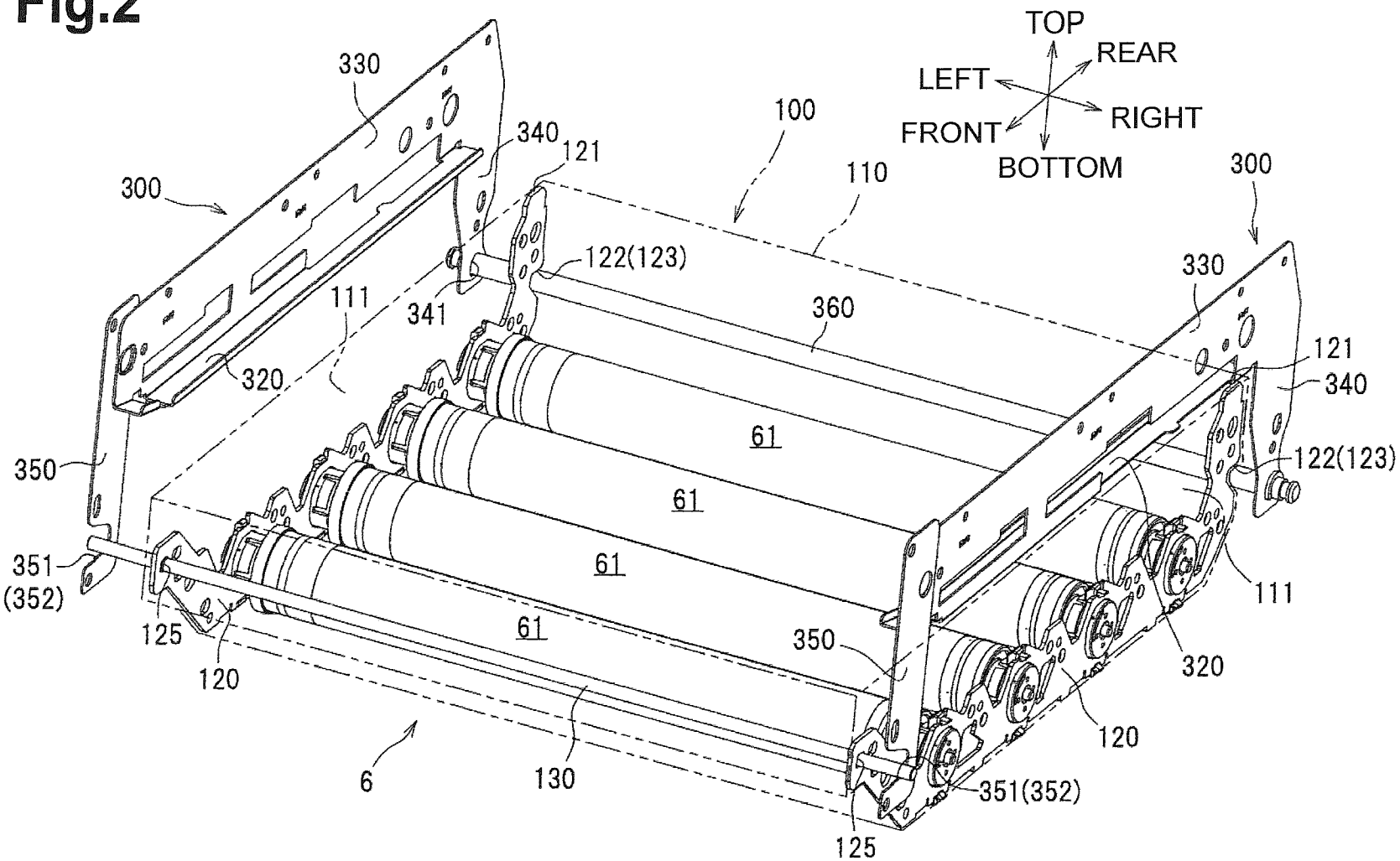
FIG. 2 is a perspective view illustrating a holder and metal frames.

As shown in FIG. 2, the holder 100 is configured to hold the photosensitive drums 61, and mainly includes a resin-made holder frame 110, which is an open-topped and bottomed box like member indicated by a two-dot chain line, and a pair of side plates 120 disposed on both sides of the photosensitive drums 61 in an axial direction thereof.

The left and right side plates 120 are formed of metal sheets, e.g. galvanized sheet iron. The side plates 120 are fixed on inner surfaces of holder side walls 111, which are left and right walls of the holder frame 110, to hold the four photosensitive drums 61 such that the photosensitive drums 61 are rotatable and positioned relative to each other. A rear end of each of the side plates 120 extends upward and includes a contact portion 121 at its upper end. The contact portion 121 protrudes slightly upward from an upper surface of each of the holder side walls 111.

The holder 100 is provided with a rod-like positioning shaft portion 130, which passes through the holder side walls 111 and the side plates 120 and protrudes outward from front end portions of the holder side walls 111 in the left-right direction. The positioning shaft portion 130 is engaged in through holes 125 formed in front end portions of the side plates 120 such that the positioning shaft portion 130 is positioned relative to the side plates 120. Each of the side plates 120 has a cut-out portion 122 which is recessed from a right end thereof. The cut-out portion 122 is shaped such that its upper edge 123 extends generally straightly along the front-rear direction.

Figures 3A, 3B:
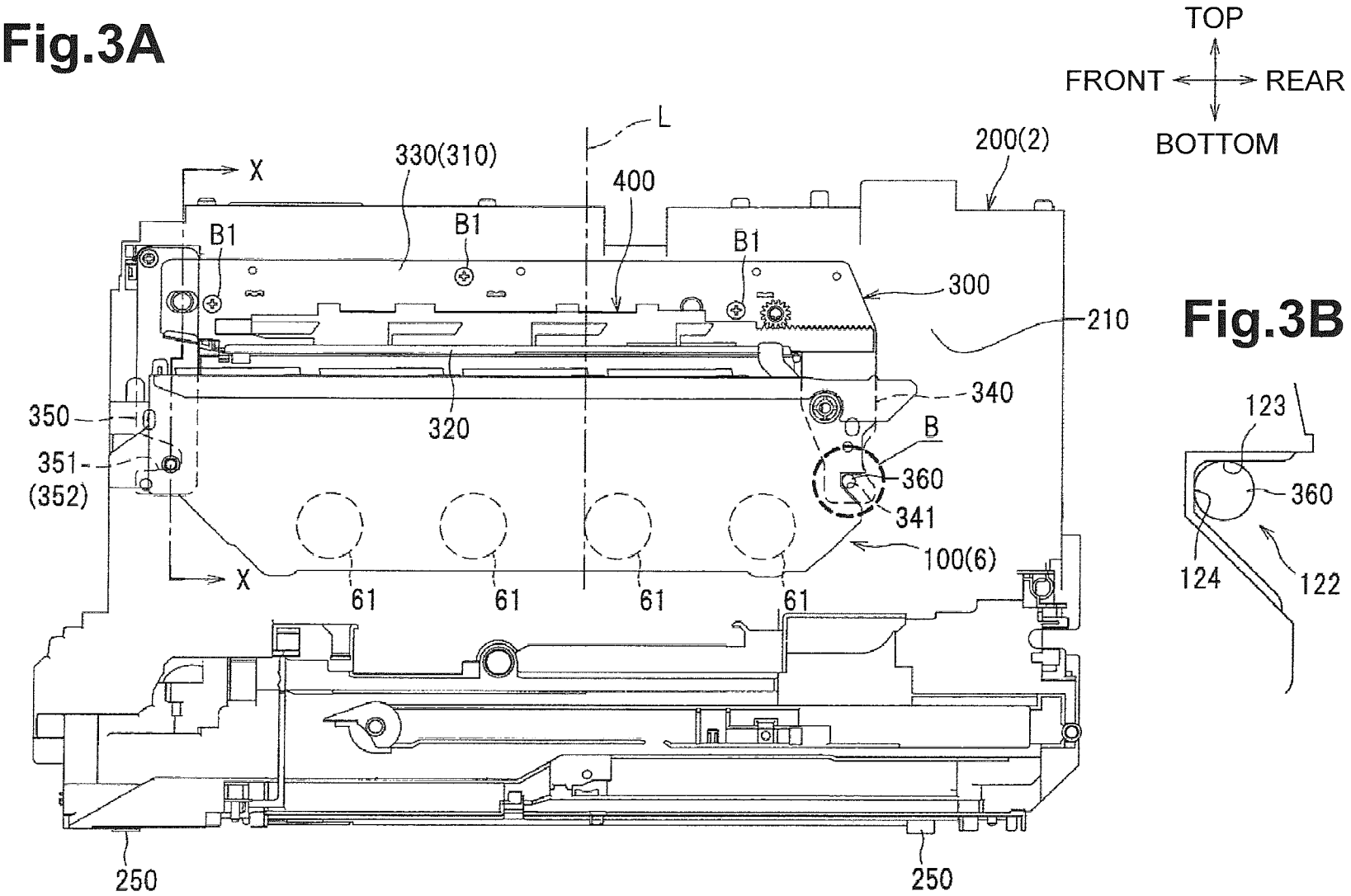
FIG. 3A illustrates a resin sidewall, the metal frame, and the holder located in an inside position viewed from inside, in a left-right direction, of the image forming apparatus.
FIG. 3B is an enlarged view of a part B shown in FIG. 3A.
Figure 4A:
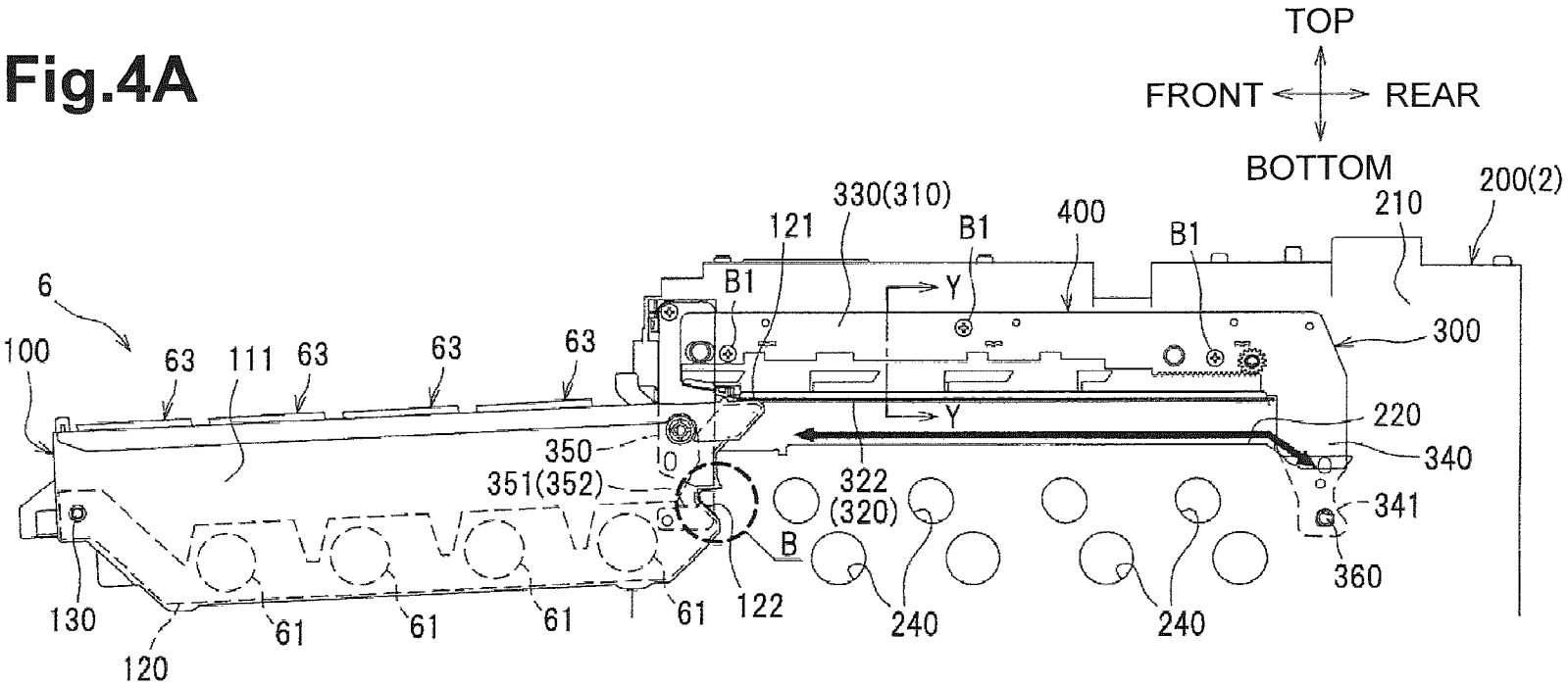
FIG. 4A illustrates the resin sidewall, the metal frame, and the holder located in an outside position as viewed from inside, in the left-right direction, of the image forming apparatus.

The holder 100 is supported by the main casing 2 such that it is movable in the front-rear direction where the photosensitive drums 61 are arranged. Thus, when the front cover 21 is open, the holder 100 is movable between an inside position where the holder 100 is mounted in the main casing 2 as shown in FIGS. 1 and 3A and an outside position where the holder 100 is pulled out from the main casing 2 as shown in FIG. 4A. The developing cartridges 63 are detachably held by the holder 100 and replaceable when the holder 100 is in the outside position.

A structure of the main casing 2 will be described in detail.

The main casing 2 includes a pair of resin sidewalls 200 spaced apart from each other in the left-right direction and a pair of metal frames 300 spaced apart from each other in the left-right direction. FIG. 3 illustrates a resin sidewall 200 and a metal frame 300, which are disposed on one side of the main casing 2. The resin sidewall 200 and the metal frame 300 are disposed one by one on each side of the holder 100 in the axial direction of the photosensitive drums 61 when the holder 100 is mounted in the main casing 2. In this embodiment, one of the metal frames 300 corresponds to an opposite frame, as viewed from the other one of the metal frames 300, which is disposed across the holder 100 from the one of the metal frames.

The following description will be made based on the left resin sidewall 200, the left metal frame 300, and a left linear cam 400 with reference to the drawings. The right resin sidewall 200, the right metal frame 300 and a right linear cam 400 are disposed in symmetrical relation to the left ones.

Figure 5:
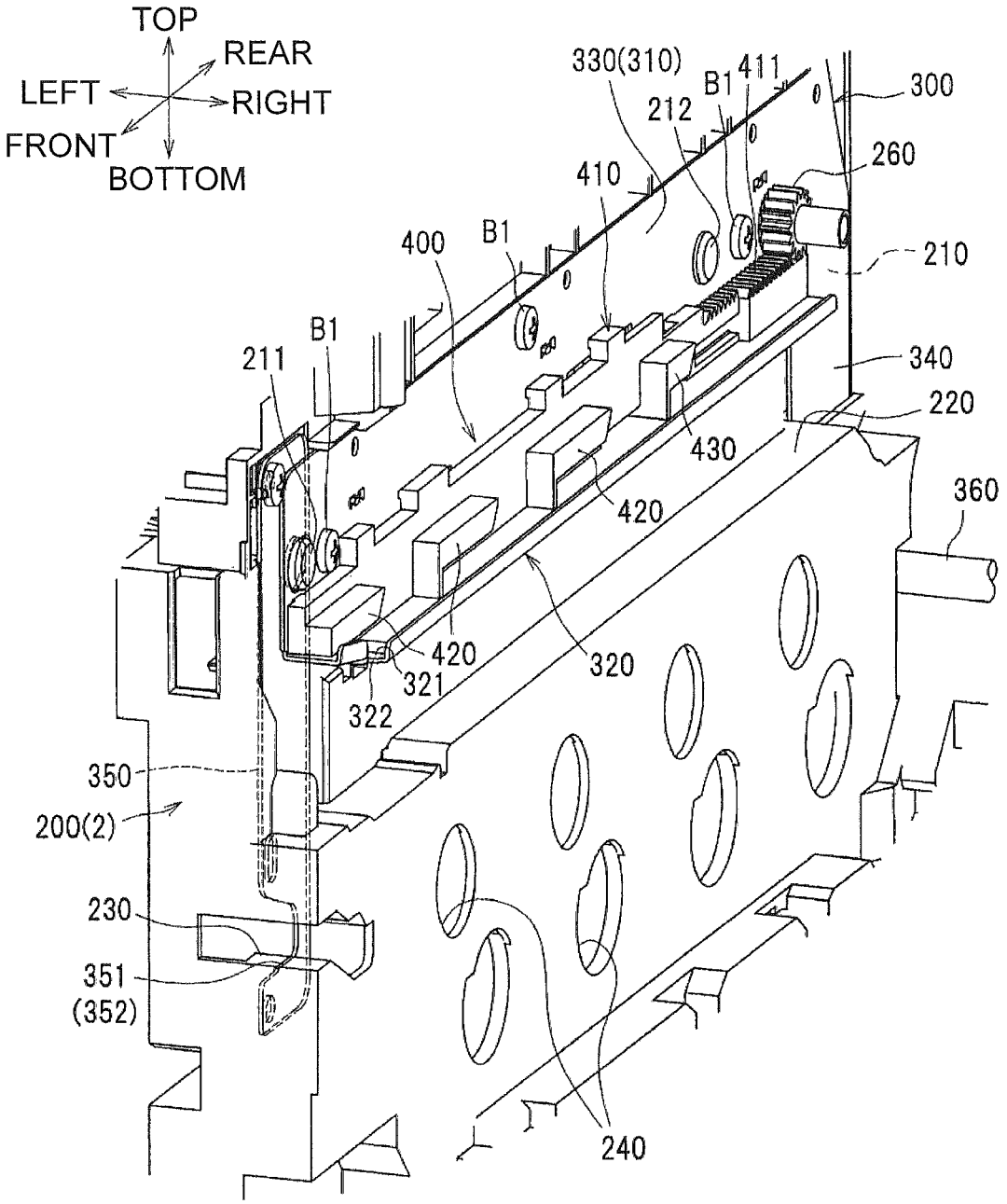
FIG. 5 is a right front perspective view of an inner wall of a left resin side wall.

The resin sidewall 200 constitutes each of the left and right walls of the main casing 2, is greater in size than the metal frame 300 as viewed from the left-right direction, and is made of a resin, e.g. ABS as an example. As shown in FIG. 5, the resin sidewall 200 includes a fixing surface 210 for fixing the metal frame 300, a holder rail 220 configured to support the holder 100 movably in the front-rear direction, a recessed portion 230 configured to receive the positioning shaft portion 130 of the holder 100, a plurality of through holes 240 where couplings (not shown) are to pass to apply driving force to the photosensitive drums 61 and the developing rollers 64, and a pair of leg portions 250, shown in FIG. 3A, configured to support the color laser printer 1 on a mounting surface, e.g. a floor.

Figure 6:
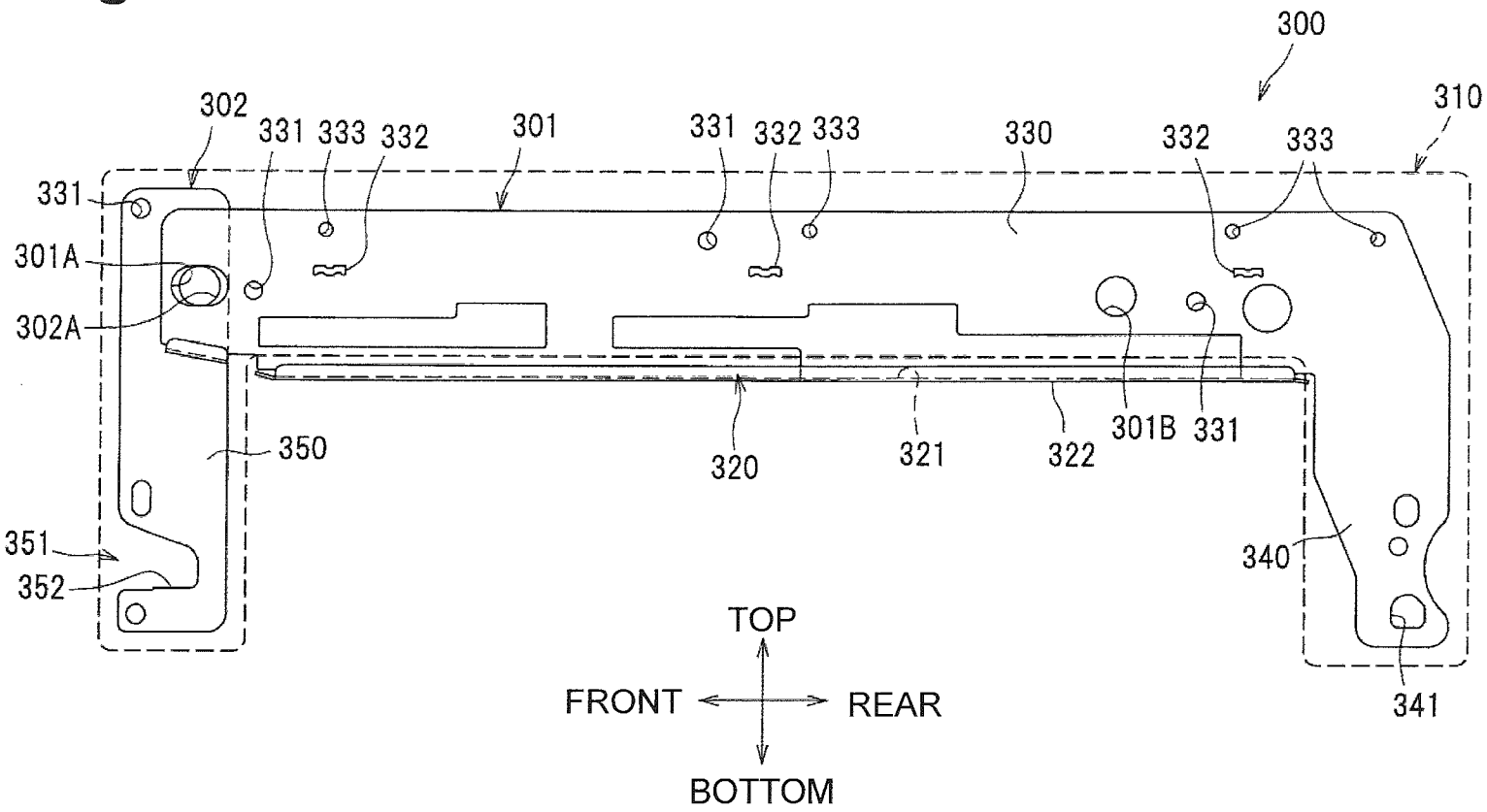
FIG. 6 illustrates the metal frame.

As shown in FIG. 6, the metal frame 300 is a plate-like member and configured to support the holder 100 mounted in the main casing 2 and positioned relative to the main casing 2. The metal frame 300 is made up of two separate parts: a first frame 301, which is L-shaped; and a second frame 302, which is I-shaped. The metal frame 300 made up of the first frame 301 and the second frame 302 is made of a metal sheet, e.g. galvanized sheet iron as an example.

The metal frame 300, in functional terms, includes a support portion 310, which is surrounded with a broken line in FIG. 6, configured to support the holder 100, and a cam rail 320 as an example of a guide portion configured to guide the linear cam 400 as an example of a changing member. The support portion 310 has a main body portion 330 and extension portions 340, 350. The main body portion 330 extends in the front-rear direction and the extension portions 340, 350 extend downward toward the photosensitive drums 61 from respective ends of the main body portion 330 in the front-rear direction. In this embodiment, the first frame 301 includes a large portion of the main body portion 330, the extension portion 340 and the cam rail 320, and the second frame 302 includes a front end portion of the main body portion 330 and the extension portion 350.

When the metal frame 300 is fixed to the resin sidewall 200 and the holder 100 is in the inside position as shown in FIG. 3A, the main body portion 330 is disposed in a position not overlapping any of the four photosensitive drums 61, the chargers 62, and the developing cartridges 63, viewed from the left-right direction. Namely, the main body portion 330 is disposed above the holder 100. As shown in FIG. 6, the main body portion 330 has screw holes 331 for fixing the metal frame 300 to the resin sidewall 200, engagement holes 332 in which a support frame 500 is to engage, and screw holes 333 for fixing the support frame 500.

The extension portions 340, 350 are disposed such that, when the metal frame 300 is fixed to the resin sidewall 200 and the holder 100 is in the inside position as shown in FIG. 3A, their lower portions face the holder 100. The extension portions 340, 350 are provided with positioning portions for positioning the holder 100 relative to the main casing 2, respectively.

More specifically, as shown in FIG. 6, the extension portion 340 is provided with a positioning hole 341 as a first positioning portion at its lower end portion. As shown in FIG. 2, a pair of extension portions 340 facing each other in the left-right direction are coupled via a coupling member 360 inserted into positioning holes 341 provided in the respective extension portions 340. End portions of the coupling member 360 are engaged in the positioning holes 341 and the coupling member 360 is fixed to the extension portions 340.

As shown in FIG. 6, the extension portion 350 is provided with a recessed portion 351, which is open toward the front side at its front end of the lower end portion. A lower edge defining the recessed portion 351 is a positioning surface 352 as a second positioning portion. The positioning surface 352 is formed as a surface extending straightly along the front-rear direction. As shown in FIG. 3A, in the state where the metal frame 300 is fixed to the resin sidewall 200, the positioning hole 341 is located closer to a center of the main casing 2 in the front-rear direction than the positioning surface 352, more specifically, the positioning hole 341 is located closer to a dot-and-dash line L indicating the center of the main casing 2 than the positioning surface 352.

Figure 7:
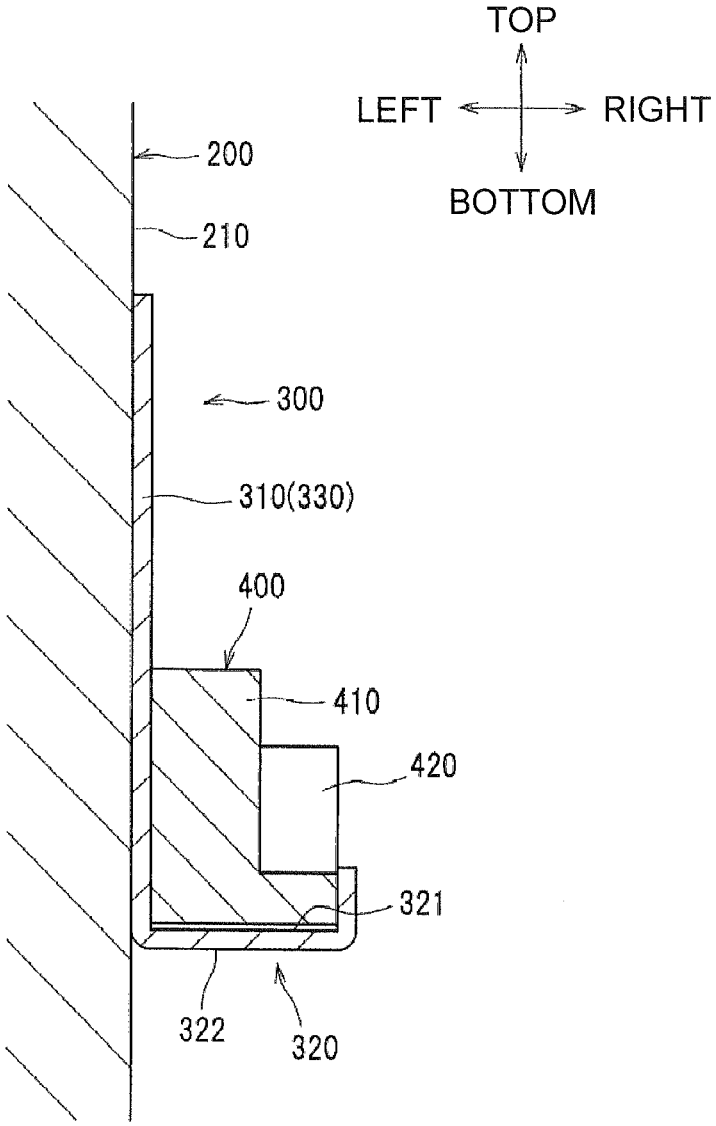
FIG. 7 is a sectional view taken along the line Y-Y of FIG. 4.

As shown in FIGS. 2 and 7, the cam rail 320 is integrally formed with the support portion 310 by bending a metal sheet forming the metal frame 300. Specifically, the cam rail 320 is L-shaped in cross section such that it extends from a lower end of the support portion 310 inwardly toward the process unit 6 in the left-right direction and then upward. The cam rail 320 is elongated in the front-rear direction.

As shown in FIG. 5, the cam rail 320 has upper and lower surfaces, which are flat surfaces perpendicular to the support portion 310, and elongated in a horizontal direction or the front-rear direction. The upper surface is a cam guide surface 321 as a changing member guiding surface for guiding movement of the linear cam 400. The lower surface is a holder guide surface 322. The holder guide surface 322 and the holder rail 220 form a space therebetween and guide movement of the holder 100 in the space.

Figure 8:
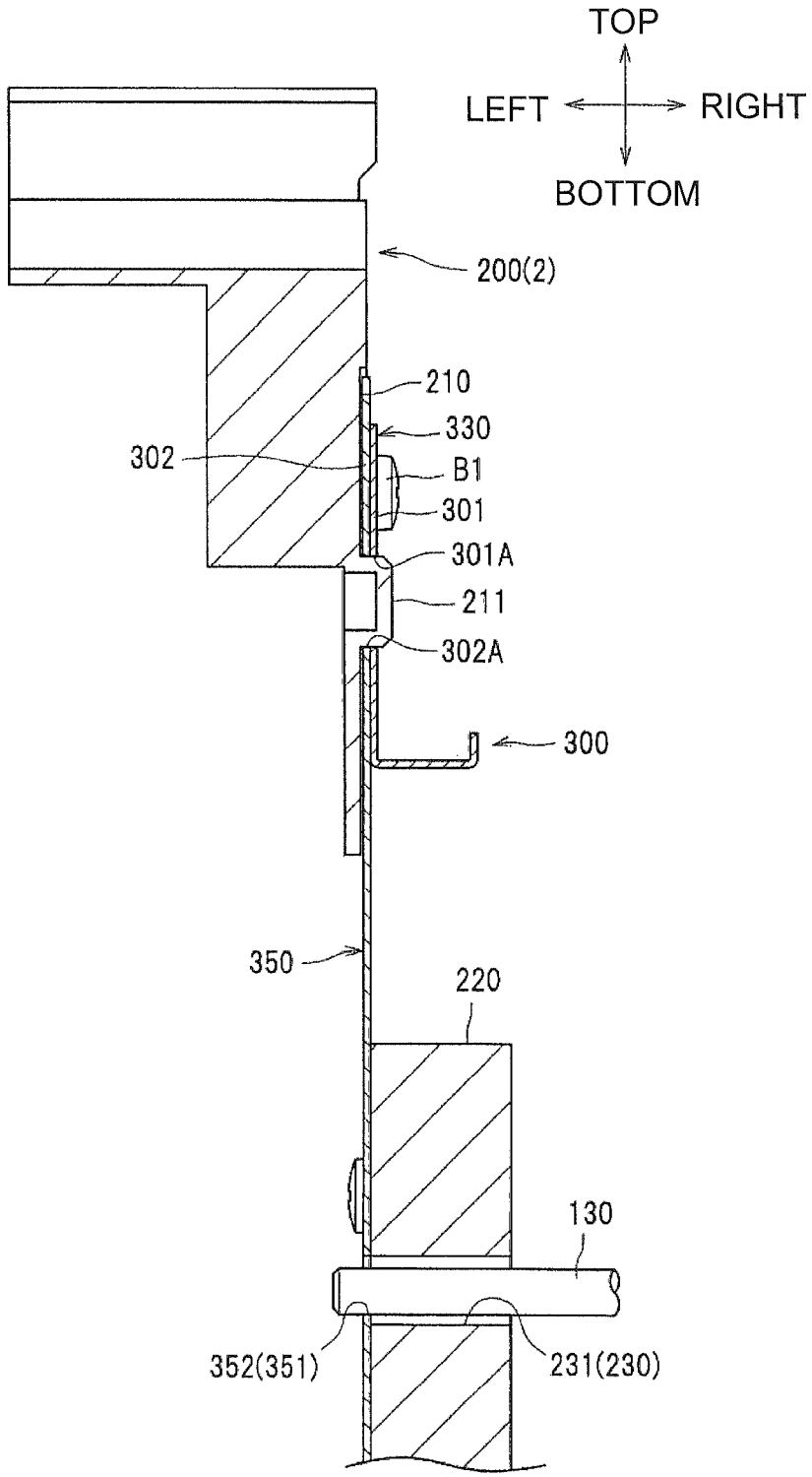
FIG. 8 is a sectional view taken along the line X-X of FIG. 3.

As shown in FIG. 8, the metal frame 300 described above is fixed to the fixing surface 210 of the resin sidewall 200 in a state that the front portion of the first frame 301 and the upper portion of the second frame 302 overlap each other such that the first frame 301 is disposed inside in the left-right direction and the second frame 302 is disposed outside in the left-right direction.

More specifically, as shown in FIGS. 5 and 6, the first frame 301 has through holes 301A and 301B, while the second frame 302 has a through hole 302A. The fixing surface 210 of the resin sidewall 200 of the main casing 2 is provided with positioning bosses 211, 212 as an example of a protrusion protruding inwardly in the left-right direction. As the though hole 301B of the first frame 301 is engaged with the positioning boss 212, the first frame 301 constituting the metal frame 300 is positioned relative to the resin sidewall 200 in the front-rear direction.

As the through hole 301A of the first frame 301 and the through hole 302A of the second frame 302 are engaged with the positioning boss 211, the first frame 301 and the second frame 302 are positioned relative to the resin sidewall 200 in the vertical direction perpendicular to both the arrangement direction and the axial direction of the photosensitive drums 61. The first frame 301 and the second frame 302 are fixed to the fixing surface 210 with screws B1 in the state where the first frame 301 and the second frame 302 are positioned relative to the resin sidewall 200 in the front-rear direction and the vertical direction.

As shown in FIG. 6, the through hole 301A of the first frame 301 is a long hole in the front-rear direction. This can absorb a dimensional deviation of the first frame 301 and dimensional changes in the front-rear direction due to difference in thermal expansion rate of the resin sidewall 200 that may expand thermally relative to the positioning boss 212 and the first frame 301 that may expand thermally relative to the through hole 301B while maintaining the positioning accuracy in the vertical direction.

As shown in FIG. 5, the holder rail 220 of the resin sidewall 200 protrudes inwardly relative to the fixing surface 210 in the left-right direction. The lower portion (not shown) of the extension portion 340 is disposed between the fixing surface 210 and the holder rail 220 in the left-right direction. As shown in FIG. 8, the lower portion (not shown) of the extension portion 350 is disposed between the fixing surface 210 and the holder rail 220 in the left-right direction. With this structure, the holder guide surface 322, which is the lower surface of the cam rail 320, and the upper surface of the holder rail 220 constitute a structure for guiding the movement of the holder 100.

Figure 9A:
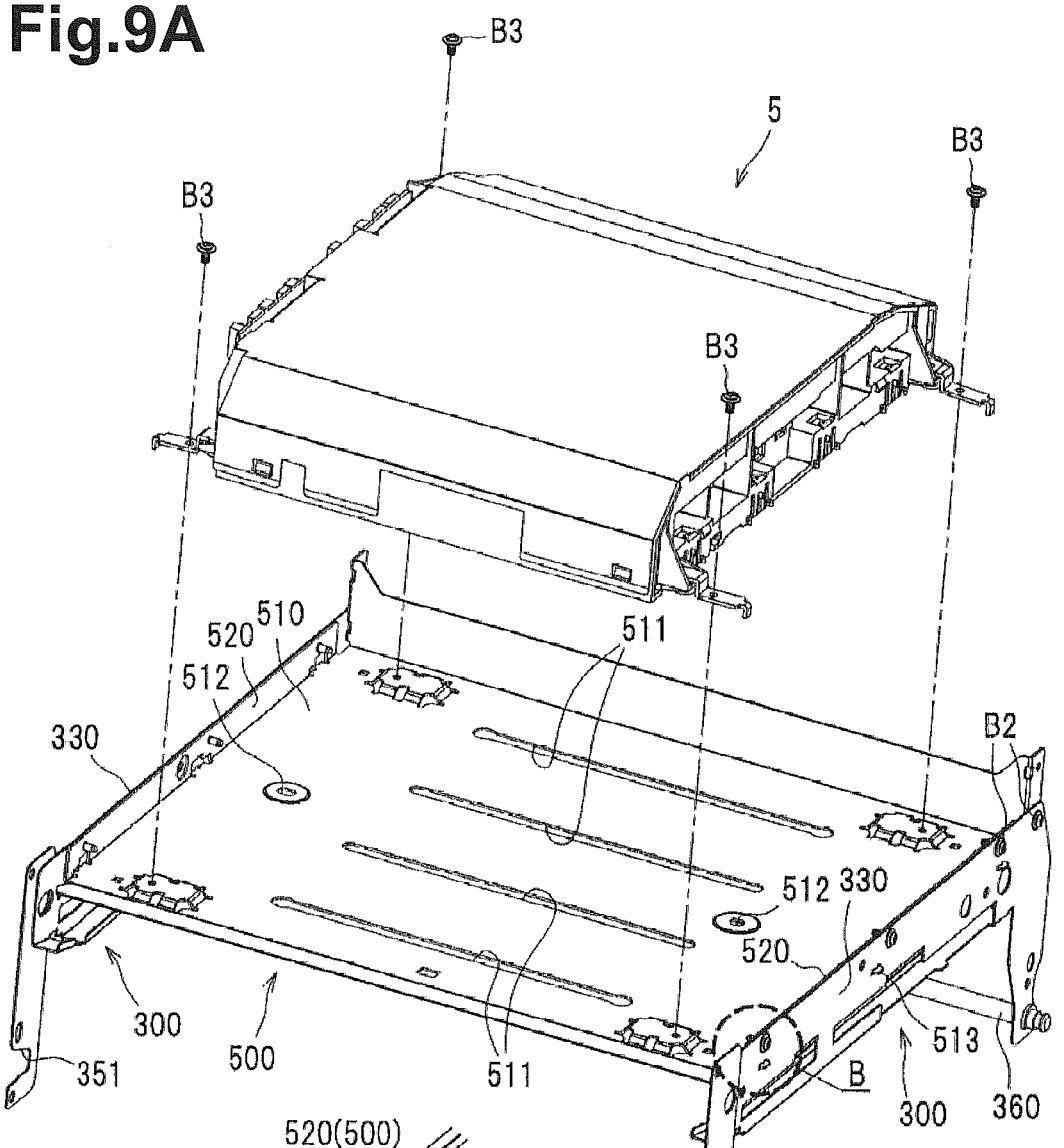
FIG. 9A is an exploded perspective view illustrating the metal frame, a support frame, and an exposure unit.

In this embodiment, as shown in FIG. 9A, the color laser printer 1 includes a support frame 500 that connects the main part portions 330 of the pair of left and right metal frames 300. The support frame 500 is formed by holding a metal sheet such as a galvanized sheet iron, and includes a plate-like portion 510 and a pair of left and right fixing portions 520 extending upward from left and right ends of the plate-like portion 510.

When the holder 100 is mounted in the main casing 2, the plate-like portion 510 is disposed between the light exposure unit 5 and the four photosensitive drums 61, which are not shown in FIG. 9A. The plate-like portion 510 connects the left and right main body portions 330 via the fixing portions 520. The plate-like portion 510 is provided with four slit-like openings 511 elongated in the left-right direction. Four streaks of laser light, which are indicated with chain lines in FIG. 1 and emitted from the light exposure unit 5, pass through the openings 511, pass through the openings 511 to expose the photosensitive drums 61 respectively. The plate-like portion 510 is formed with two circular positioning holes 512, which are spaced apart from each other in the left-right direction and substantially centered in the front-rear direction. The positioning holes 512 is configured to engage positioning bosses (not shown) provided on the lower surface of the light exposure unit 5.

Figure 9B:
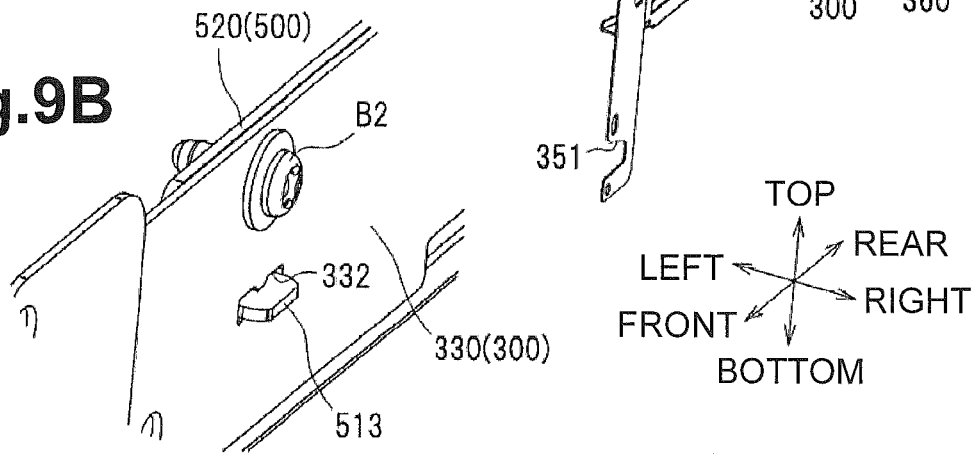
FIG. 9B is an enlarged view of a part B shown in FIG. 9A.

As shown in FIG. 9B, the support frame 500 is fixed to each main body portion 330 by fixing the main body portion 330 and the fixing portion 520 with a screw B2 in a state where an engagement tab 513 protruding outward from each end of the plate-like portion 510 in the left-right direction is engaged into an engagement hole 332 formed in the main body portion 330.

As shown in FIG. 9A, the light exposure unit 5 is positioned relative to the support frame 500 fixed to the metal frames 300 by engaging the positioning bosses (not shown) provided on the lower surface of the light exposure unit 5 in the positioning holes 512 formed in the plate-like portion 510. The light exposure unit 5 is fixed on an upper surface of the plate-like portion 510 with screws B3 and supported by the main body portions 330 of the metal frames 300 via the support frame 500.

As shown in FIG. 5, the linear cam 400 is configured to move along the cam rail 320 of the metal frame 300 in the front-rear direction and move the developing roller 64 between a first position where the developing roller 64 contacts the corresponding photosensitive drum 61 and a second position where the developing roller 64 is separated from the corresponding photosensitive drum 61. The linear cam 400 mainly includes a cam main body 410, functioning as a changing member main body, elongated in the front-rear direction and four contact portions 420, 430 protruding inwardly from an inner surface of the cam main body 410 in the left-right direction.

The cam main body 410 is supported by the cam rail 320 such that it is movable on the cam guide surface 321 in the front-rear direction. The cam main body 410 includes a rack gear 411 on an upper surface of a rear end portion. The rack gear 411 engages a pinion gear 260 disposed in the main casing 2. The linear cam 400 moves rearward when the pinion gear 260 rotates counterclockwise, and moves forward when the pinion gear 260 rotates clockwise.

Figure 10:
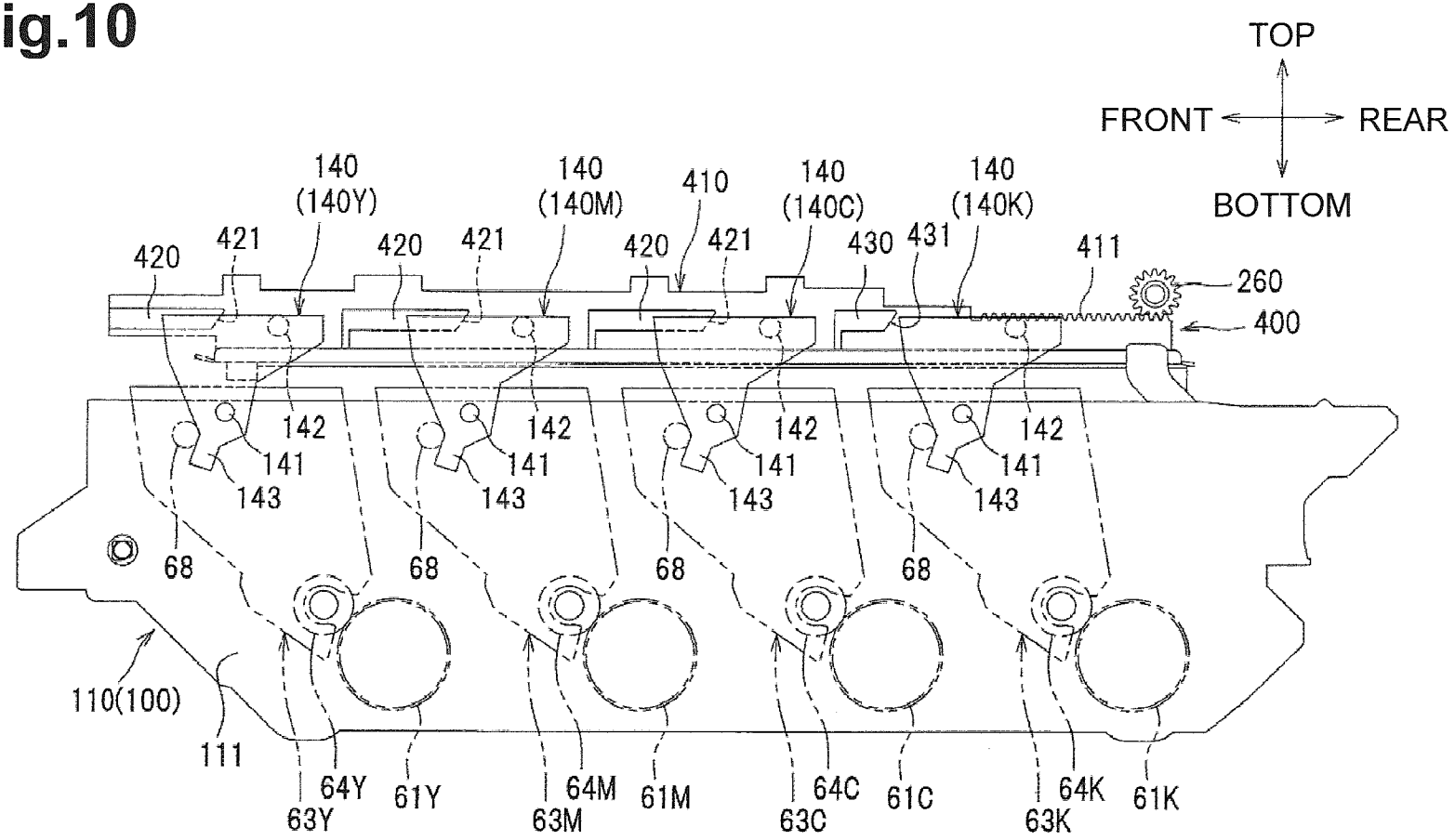
FIG. 10 illustrates that all developing rollers contact corresponding photosensitive drums.

As shown in FIG. 10, the contact portions 420, 430 have respective rear surfaces inclined downward to the front side, which are inclined surface 421, 431. The rearmost contact portion 430 is shorter in dimension in the front-rear direction than other contact portions 420 disposed in front of the contact portion 430.

FIG. 10 illustrates only one side, however, a further and similar linear cam 400 is provided on the other side. The linear cams 400 are symmetrically disposed on both sides of the process unit 6 in the left-right direction.

The following will describe a structure of the holder 100 as a contact/separation mechanism for moving the linear cam 400 to bring the developing roller 64 into contact with the corresponding photosensitive drum 61 or separate the developing roller 64 from the corresponding photosensitive drum 61.

Although only one side is shown in FIG. 10, four pivotable members 140 are disposed in an upper portion of an inner surface of each of the left and right holder sidewalls 111 of the holder frame 110 such that the pivotable members 140 are pivotable about respective pivot shafts 141 in the front-rear direction. The pivotable members 140 are pivotally urged by urging members (not shown). The pivotable members 140 are kept in positions shown in FIG. 10 by contacting stoppers (not shown) provided to the holder wall 111.

Each pivotable member 140 mainly includes a contacted portion 142 provided above the pivot shaft 141 and a pressing portion 143 provided below the pivot shaft 141.

The contacted portion 142 is disposed such that it protrudes outwardly from an outer surface of the pivotable member 140 in the left-right direction in a position where it can contact a corresponding one of the inclined surfaces 421, 431 of the contact portions 420, 430 of the linear cam 400 moving in the front-rear direction. The pressing portion 143 extends downward from a location close or proximate to the pivot shaft 141, and contacts a pressure boss 68 protruding outwardly from a side surface of the developing cartridge 63.

The following will describe operation of the linear cam 400 and operation for bringing the developing roller 64 into contact with the corresponding photosensitive drum 61 or separating the developer roller 64 from the corresponding photosensitive drum 61.

In the following description, to specify a component corresponding to a color of toner, such as the photosensitive drum 61 and the developing roller 64, a suffix Y for yellow, M for magenta, C for cyan, or K for black will be added to a reference number of the component in the specification and drawings.

When a color image is formed on a sheet S using four colors of toner, yellow, magenta, cyan, and black, image formation operation is carried out in a state where all the developing rollers 64 contact the respective photosensitive drums 61 as shown in FIG. 10.

Figure 11:
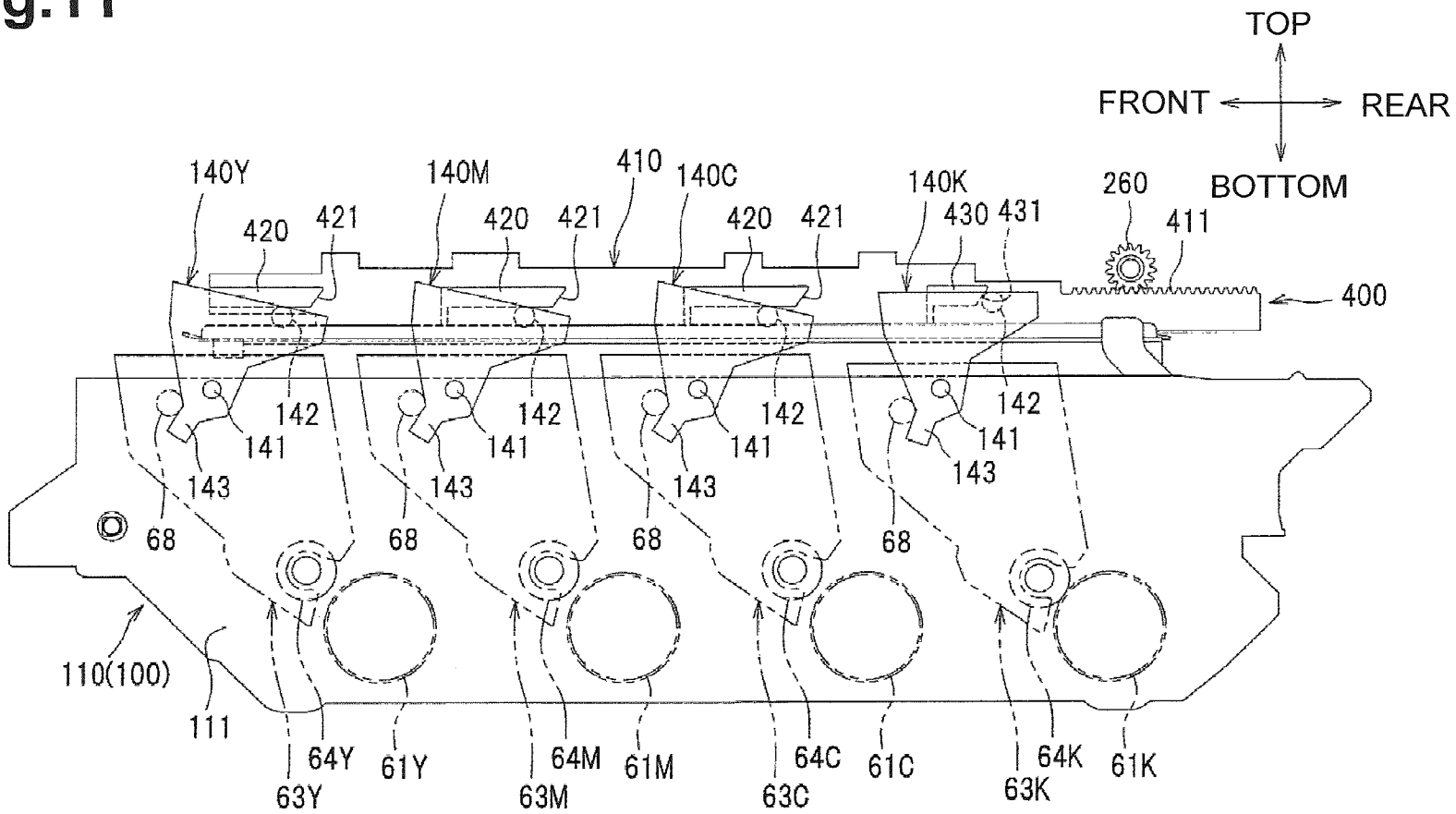
FIG. 11 illustrates that a developing roller for black color only contacts a corresponding photosensitive drum.

When a monochrome image is formed on a sheet S using the black toner only, the linear cam 400 is operated such that the developing roller 64K only is brought into contact with the photosensitive drum 61K and the developing rollers 64Y, 64M, and 64C are separated from the photosensitive drums 61Y, 61M, and 61C as shown in FIG. 11.

Specifically, for monochrome image formation, since the pinion gear 260 rotates counterclockwise from the state shown in FIG. 10, the linear cam 400 moves rearward. Thus, the inclined surfaces 421 of the front three contact portions 420 contact the contacted portions 142 of the pivotable members 140Y, 140M, and 140C. When the linear cam 400 moves further rearward, the inclined surfaces 421 press the contacted portions 142, and thus the pivotable members 140Y, 140M, and 140C pivot about the respective pivot shafts 141 clockwise.

Thus, the pressing portions 143 of the pivotable members 140Y, 140M, and 140C press the bosses 68 of the developing cartridges 63Y, 63M, 63C upward to the front side, and the developing rollers 64Y, 64M, and 64C are separated from the respective photosensitive drums 61Y, 61M, and 61C. As the rearmost contact portion 430 is shorter than the contact portions 420 in the front-rear direction, it does not interfere with the pivotable member 140K in the above operation. With this structure, the developing roller 64K is maintained in contact with the photosensitive drum 61K. When the image formation is carried out in the state shown in FIG. 11, a monochrome image is formed on a sheet S.

As the developing rollers 64Y, 64M, and 64C, which are not used for image formation, are separated from the photosensitive drums 61Y, 61M, and 61C, respectively, operation of the developing rollers 64Y, 64M, and 64C can be stopped. Thus, this structure can reduce stresses on yellow toner, magenta toner, and cyan toner, which are not used for image formation, thereby increasing their lifespan.

In this embodiment, all developing rollers 64 can be separated from the respective photosensitive drums 61 for cleaning of the conveyor belt 73. Specifically, when the pinion gear 260 rotates counterclockwise from the state shown in FIG. 11, the linear cam 400 moves further rearward. Thus, the inclined surface 431 of the contact portion 430 contacts the contacted portion 142 of the pivotable member 140K, and the developing roller 64K is separated from the photosensitive drum 61K as shown in FIG. 12.

Figure 12:
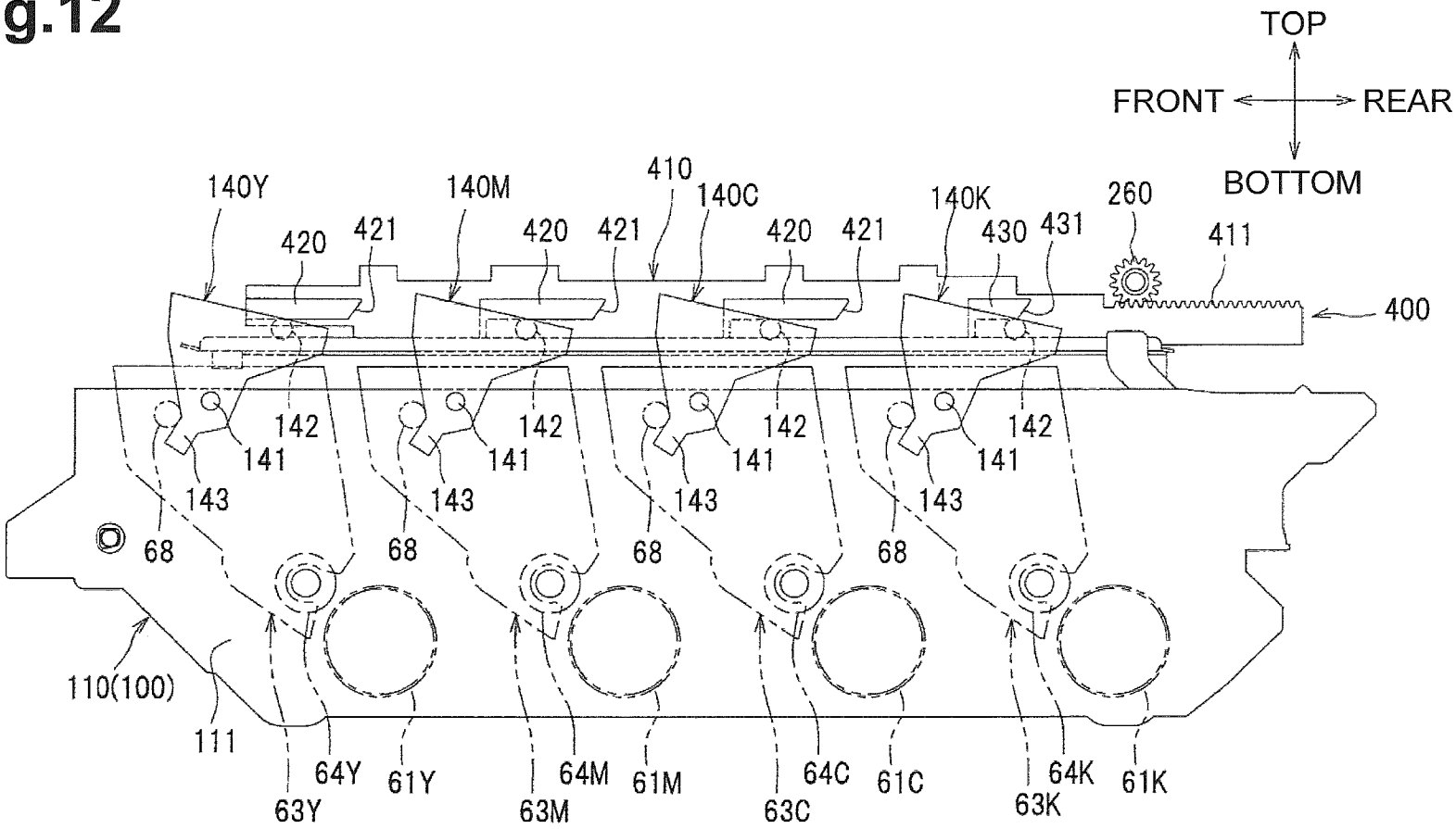
FIG. 12 illustrates that all developing rollers are separated from the corresponding photosensitive drums.

To cause the developing roller 64K to contact the photosensitive drum 61K from the state shown in FIG. 12, the pinion gear 260 rotates clockwise and the linear cam 400 moves forward. Thus, the contact portion 430 is disengaged from the contacted portion 142, and the pivotable member 140K pivots about the pivot shaft 141 counterclockwise by an urging force from the urging member (not shown) as shown in FIG. 11. Since the pressing portion 143 moves downward, the developing cartridge 63K moves diagonally downward to the rear side accordingly, and the developing roller 64K contacts the photosensitive drum 61K.

To cause the developing rollers 64Y, 64M, and 64C to contact the photosensitive drums 61Y, 61M, and 61C from the state shown in FIG. 11, the pinion gear 260 rotates clockwise and the linear cam 400 moves further frontward. Thus, the contact portions 420 are disengaged from the respective contacted portions 142, and the developing rollers 64Y, 64M, and 64C contact the respective photosensitive drums 61Y, 61M, and 61C as shown in FIG. 10.

The following will describe how the holder 100 is positioned relative to the main casing 2.

When the holder 100 placed in the outside position shown in FIG. 4A is pressed rearward, the holder 100 moves rearward along the holder rail 220 and the holder guide surface 322 of the cam rail 320. When the holder 100 moves to a location close to the inside position, the positioning shaft portion 130 of the holder 100 enters the recessed portion 351 of the metal frame 300 and the coupling member 360 enters the cut-out portion 122 of the holder 100.

As shown in FIGS. 2 and 3A, when the holder 100 arrives at the inside position and is mounted in the main casing 2, the positioning shaft portion 130 engages the recessed portion 351, the cut-out portion 122 engages the coupling member 360. Thus, the holder 100 is supported by the metal frame 300 and is positioned relative to the main casing 2 in the vertical direction and the front-rear direction.

More specifically, as shown in FIG. 8, the recessed portion 351 is located such that the positioning surface 352, which is the lower edge of the recessed portion 351, protrudes further upward than a lower end 231 of the recessed portion 230 formed in the resin sidewall 200. Thus, when the positioning shaft portion 130 engages the recessed portion 351, it rests directly on the positioning surface 352 and is supported by the positioning surface 352 from below, thereby the front side of the holder 100 is positioned in the vertical direction.

Figure 4B:
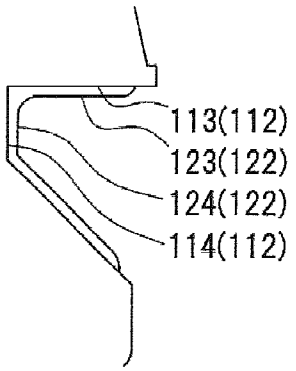
FIG. 4B is an enlarged view of a part B shown in FIG. 4A.

As shown in FIG. 4B, the cut-out portion 122 is disposed such that an upper end 123 thereof protrudes downward further than an upper end 123 of a recessed portion 112, corresponding to the cut-out portion 122, of the holder frame 110 and that a front end 124 of the cut-out portion 122 protrudes rearward further than a front end 114 of the recessed portion 112. Thus, as shown in FIG. 3B, when the coupling member 360 engages the cut-out portion 122, the front end 124 of the recessed portion 122 of the holder 100 directly contacts the coupling member 360 engaged in the positioning hole 341 so that the holder 100 is positioned in the front-rear direction. In addition, the upper end 123 of the cut-out portion 122 directly rests on the coupling member 360 and the holder 100 is supported from below by the coupling member 360. Thus, the rear side of the holder 100 is positioned vertically.

In the embodiment, as the positioning shaft portion 130 and the upper end 123 and the front end 124 of the cut-out portion 122, which are provided to the holder 100, directly contact the positioning surface 352 of the metal frame 300 and the coupling member 360 engaged in the positioning hole 341, the positional accuracy of the holder 100 increases.

As shown in FIG. 4A, when the holder 100 is located in the outside position, the front end portion of the holder 100 is lowered by gravitation and thus the rear end portion thereof is raised. Therefore, the contact portion 121 of the side plate 120 contacts the holder guide surface 322. The metal frame 300 is grounded via a conducing member (not shown) provided to the main casing 2. The side plate 120 made of metal is electrically continuous with drum base tubes, each having conductivity, of the photosensitive drums 61. When the holder 100 is in the outside position, the photosensitive drums 61 can be grounded as a point of contact between the holder guide surface 322 and the contact portion 121.

According to the color laser printer 1 described in the above embodiment, the following effects can be obtained.

Each metal frame 300 is disposed in a position where the main body portion 330 does not overlap the holder 100 holding the photosensitive drums 61 as viewed from the left-right direction. The metal frame 300 is reduced in size and weight in comparison to that the metal frame is disposed to cover the side surface of the holder entirely. The side surface of the holder 100 is not covered with the main body portion 330, which can provide a high degree of flexibility in dispositions of gears and couplings for applying driving force to the photosensitive drums 61 and the developing rollers 64, and electrodes for applying bias and grounding.

The position of the holder 100 in the front-rear direction is determined by the coupling member 360 engaged in the positioning holes 341. This can absorb dimensional difference between the holder 100 and the metal frames 300 and relieve dimensional change between the metal frames 300 and the resin sidewalls 200, which are susceptible to thermal expansion, in the front-rear direction. Thus, the positional accuracy of the photosensitive drums 61 held by the holder 100 can be assured.

Figure 13:
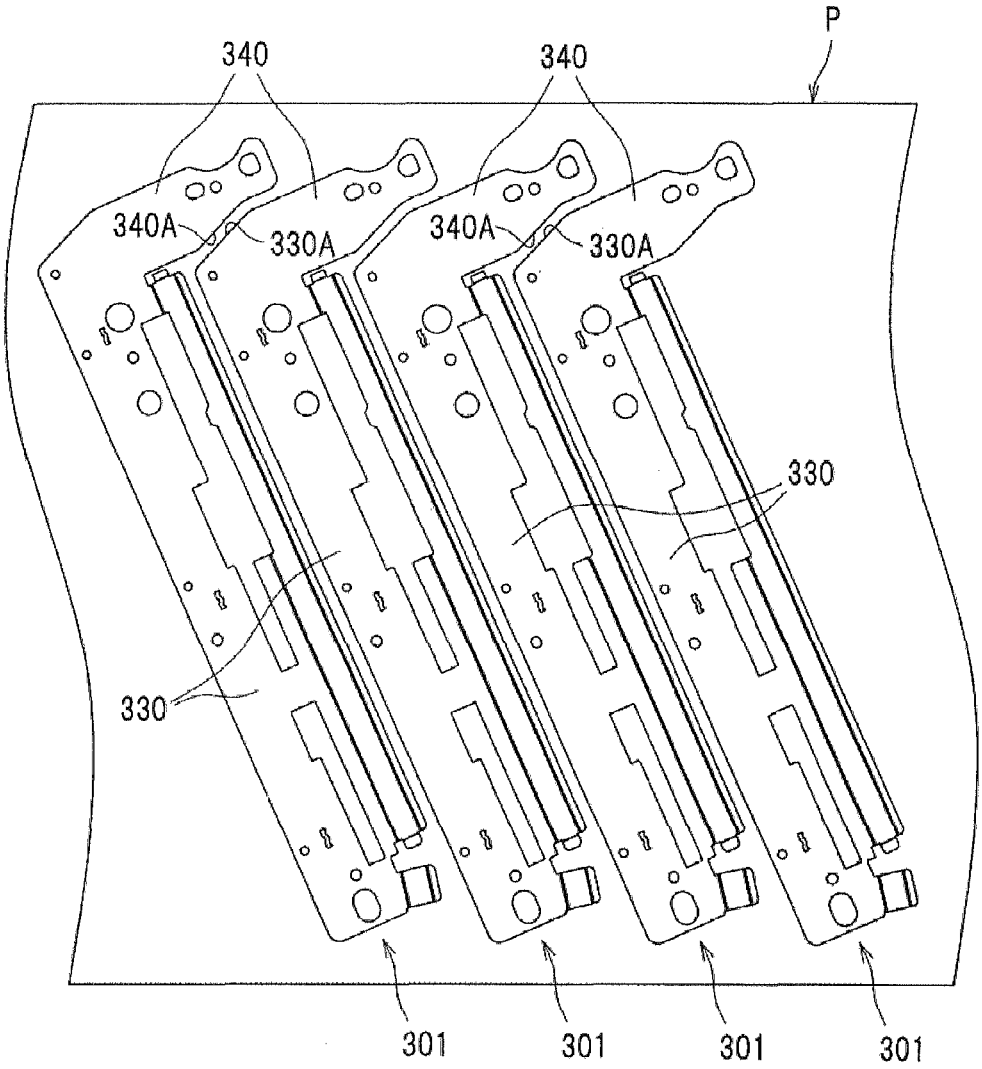
FIG. 13 illustrates a metal sheet material.

As the metal frames 300 are each made up of two parts, they can be efficiently made out of a sheet metal material. More specifically, if the main body portion and the pair of extension portions are integrally formed, the metal frame is U-shaped. Even if the U-shaped metal frame is made out of a sheet metal material, the sheet metal material enclosed by the main body portion and the extension portions is likely to go to waste. In this embodiment, the metal frame 300 is made up of the L-shaped first frame 301 and the I-shaped second frame 302 to form a U-shaped structure. Thus, for example, as shown in FIG. 13, the first frames 301 can be efficiently produced out of a metal sheet material P because the first frames 301 can be arranged adjacently to each other with a minimum space therebetween in comparison to a case where the U-shaped metal frames are arranged on the metal sheet material P. The same applies to production of the I-shaped second frames 302. This can increase productivity of the metal frames 300 and limit the manufacturing costs thereof. In this embodiment, to efficiently produce the first frames 301, an end portion 330A, which is shown as positioned on an upper side of each main portion 330, is shaped along the shape of an end portion 340A, which is shown as positioned on a lower side of each extension portion 340.

As the holder 100 is positioned by the metal frames 300 supporting the light exposure unit 5, the positional accuracy between the photosensitive drums 61 held by the holder 100 and the light exposure unit 5 can be increased. Especially in this embodiment, the metal frame 300 is made up of the two parts, the first frame 301 and the second frame 302. The positioning holes 341 for positioning the holder 100 in both the vertical direction and the front-rear direction are formed in the first frame 301 including the main body portion 330 on which the light exposure unit 5 is supported. Thus, the positional accuracy between the photosensitive drums 61 and the light exposure unit 5 can be assured.

As the first frame 301 and the second frame 302 are positioned in the vertical direction by engaging through holes 301A and 302A with the positioning boss 211, the positional accuracy of the metal frame 300 made up of the two parts in the vertical direction can be maintained. Even if the position of the positioning boss 211 changes as a result of thermal expansion of the resin sidewall 200, the through hole 301A, which is long in the front-rear direction, can absorb the positional change.

The resin sidewalls 200 of the main casing 2 are made of resin and contribute to a reduced weight of the apparatus compared with a case where the sidewalls of the main casing are made of metal. In addition, the resin sidewall 200 and the metal frame 300 are separately provided to form each of the sidewalls of the main casing 2. The metal frames 300 can be sized to position the holder 100 and thus the size and weight of the metal frames 300 can be further reduced. As the holder 100 is positioned by the metal frames 300, the resin sidewalls 200 can be formed of an inexpensive resin and thus costs of the apparatus can be lowered.

The photosensitive drums 61 are positioned by the holder 100. Thus, when the holder 100 is mounted in the main casing 2, the positional accuracy of the photosensitive drums 61 can be maintained. Especially in this embodiment, the positions of the photosensitive drums 61 are determined by the side plates 120 formed of metal having less dimensional change due to temperature changes and higher dimensional accuracy compared with resin. Thus, the positional accuracy of the photosensitive drums 61 can be further improved.

The light exposure unit 5 is supported by the support frame 500, which facilitates positioning of the light exposure unit 5 especially in the left-right direction, compared with a case where the light exposure unit is directly fixed to the metal frames. Thus, the positional accuracy between the photosensitive drums 61 and the light exposure unit 5 can be further improved.

The left and right metal frames 300 are connected by the plate-like portion 510 having the openings 511. This structure can allow laser light emitted from the light exposure unit 5 to be directed at the photosensitive drums 61 and provide greater rigidity in the main casing 2.

The positioning holes 341 are located closer to the center of the main casing 2 in the front-rear direction than the positioning surface 352. As a reference position of the holder 100 in the front-rear direction is to the center of the main casing 2, the positional accuracy of the holder 100 can be maintained.

The cam rail 320 is integrally formed with the support portion 310 by bending the metal sheet. Compared with a case where a cam rail is attached to a metal frame as a separate part, the number of parts can be reduced, and thus assembly of the apparatus can be improved. Thus, costs on parts and assembly can be held down. In addition, as the cam rail 320 is integrally formed with the metal frame 300, the positional accuracy of the linear cam 400 can be maintained with relative ease. Further, as the cam rail 320 is formed by bending along the front-rear direction, the rigidity in the main body portion 330 of the metal frame 300 can be improved.

As the guide surface 321 that guides the movement of the cam main body 410 is flat, the linear cam 400 can be smoothly and stably operated.

As the metal frame 300 is provided with the cam rail 320, the positioning hole 341 and the positioning surface 352, the positional accuracy between the linear cam 400 and the process unit 6 can be improved. With this structure, the position of the process unit 6 can be smoothly changed by the movement of the linear cam 400. Especially in this embodiment, the positioning portion is provided on each end of the metal frame 300 in the front-rear direction, and thus a degree of parallelism between the moving direction of the linear cam 400 and the process unit 6 can be improved. Thus, the position of the process unit 6 can be changed smoothly by the movement of the linear cam 400.

As the holder 100 can be pulled out from the main casing 2, consumables such as the developing cartridges 63 can be easily replaced. Even if the holder 100 is removable from the main casing 2, the positional accuracy between the linear cams 400 and the process unit 6 can be maintained by the positioning holes 341 and the positioning surfaces 352.

The holder guide surface 322 of the cam rail 320 guides the movement of the holder 100. Compared with a structure where a guide for guiding the linear cam and a guide for guiding the holder are separately provided, it becomes possible to lower costs on the apparatus, simplify structures of the apparatus, and reduce the sizes of the metal frames 300 and the laser printer 1.

The linear cam 400 and the metal frame 300 are provided on each side of the process unit 6. Compared with a structure where the linear cam and the metal frame are provided on only one side of the process unit, the position of the process unit 6 can be changed smoothly and stably by the movement of the linear cam 400.

The above embodiment shows, but is not limited to, that the cam rail 320 extends in the front-rear direction and guides the movement of the holder 100. The cam rail may be configured to guide only the linear cam 400 as a changing member.

Figure 14A:
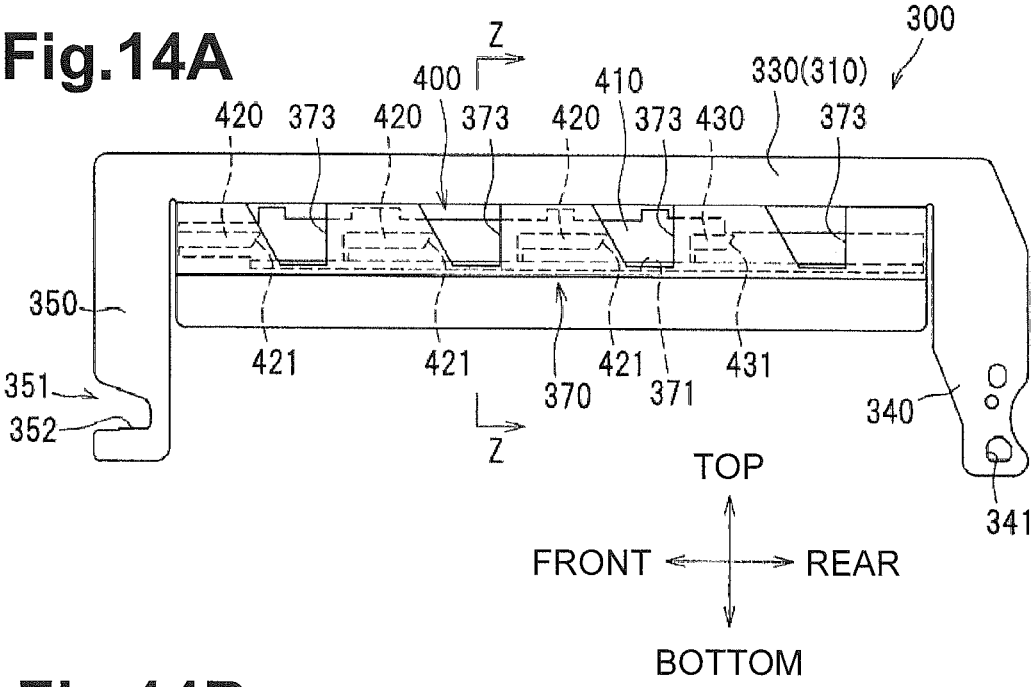
FIG. 14A is a front view of a metal frame according to a modification of the embodiment.
Figure 14B:
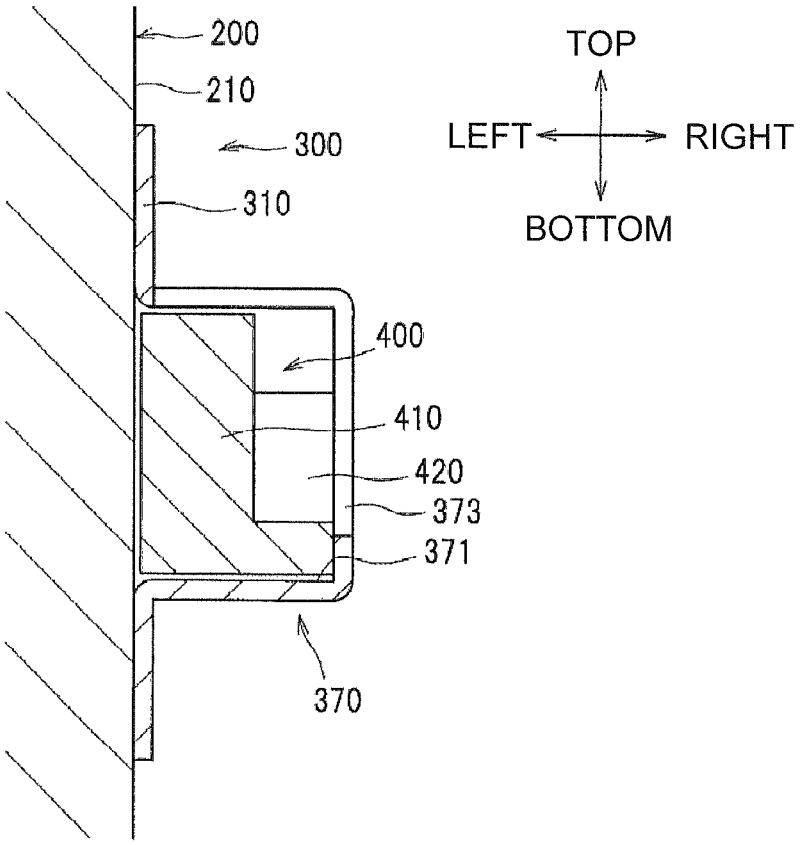
FIG. 14B is a sectional view taken along the line Z-Z of FIG. 14A.

The above embodiment shows, but is not limited to, that the structure of the cam rail 320 as a guide portion. For example, as shown in FIGS. 14A and 14B, the metal frame 300 is bent to form a hollow protrusion portion protruding inward from the support portion 310 in the left-right direction and having a U-shape in cross section. A hollow portion of the protrusion portion may be used as a guide 370 for guiding the movement of the linear cam 400. The cam main body 410 of the linear cam 400 disposed within the guide 370 may move along the guide surface 371, which is a lower surface of the guide 370, in the front-rear direction. The guide 370 is provided with openings 373 through which the contacted portions 142 of the pivotable members 140 shown in FIG. 10, which are some of the process unit 6, can pass. Thus, inclined surfaces 421, 431 of contact portions 420, 430 provided in the linear cam 400 can contact the contacted portions 142. Accordingly, as is the case with the above embodiment, the movement of the linear cam 400 causes the developing rollers 64 to contact or be separated from the corresponding photosensitive drums 61.

The above embodiment shows, but is not limited to, that the structure of the linear cam 400 and the contact/separation mechanism disposed on the holder 100. For example, known structures disclosed in i.e. Japanese Laid-Open Patent Publication No. 2010-156791 may be applied to the structures of the linear cam and the contact/separation mechanism disposed on the holder.

The above embodiment shows, but is not limited to, that the linear cam 400 functioning as a changing member, which is configured to change the position of the developing roller 64 between a contact position as the first position where the developing roller 64 contacts the corresponding photosensitive drum 61 and a separation position as the second position where the developing roller 64 is separated from the corresponding photosensitive drum 61. In other words, in the disclosure, the changing member may be configured to move at least a part of the image forming unit between the first position and the second position by moving in a direction where the photosensitive drums are arranged. An object whose position is changed by the changing member and a structure of the changing member are not limited to the disclosure. Taking FIG. 1 as an example, the changing member may be configured to move in the front-rear direction to move a process cartridge including both the photosensitive drum 61 and the developing roller 64 between a first position where the photosensitive drum 61 contacts the conveyor belt 73 and a second position where the photosensitive drum 61 is separated from the conveyor belt 73. Alternatively, the changing member may be configured to move in the front-rear direction to move the process unit 6 vertically between a first position where the photosensitive drum 61 contacts the conveyor belt 73 and a second position where the photosensitive drum 61 is separated from the conveyor belt 73.

The above embodiment shows, but is not limited to, that the metal frames 300 are disposed on the left and right sides of the holder 100. Only one metal frame may be disposed on one side of the holder 100 in the axial direction of the photosensitive drum. In a structure where the metal frame is disposed only one side of the holder, a frame made of metal or other material may be disposed opposite to the metal frame with the holder interposed therebetween. The support frame and the coupling member 360 may be disposed between the metal frame and the frame opposite to the metal frame.

The above embodiment shows, but is not limited to, the support frame 500 having plate-like portion 510. For example, the support frame may be shaped like a beam. The above embodiment shows, but is not limited to, the exposure unit 5 supported by the main body portion 330 of the metal frame 300 via the support frame 500. For example, the exposure unit may be directly supported by the main body portion of the metal frame. Alternatively, the exposure unit may be supported by not a metal frame but a side wall of the main body.

The above embodiment shows, but is not limited to, the positioning hole 341 as the first positioning portion for positioning the position of the holder 100 in both the vertical direction and the front-rear direction via the coupling member 360 and the positioning surface 352 as the second positioning portion for positioning the holder 100 in only the vertical direction. The above embodiment shows, but is not limited to, that the first positioning portion and the second positioning portion are functionally different from each other. The first positioning portion and the second positioning portion may be functionally identical. The structures of the first positioning portion and the second positioning portions are just one example. The first positioning portion and the second positioning portion may be structured in a known way.

The above embodiment shows, but is not limited to, that the first frame 301 and the second frame 302 are positioned in the vertical direction relative to the main casing 2 by engaging the boss 211 in the through holes 301A and 302A. The through holes to be engaged with the cylindrical boss 211 may be circular in shape. The through hole provided in the second frame may be a long hole as well as the through hole provided in the first frame.

The above embodiment shows, but is not limited to, the metal frame 300 made up of two parts, the first frame 301 and the second frame 302. The metal frame may be a single part or made up of three or more parts.

The above embodiment shows, but is not limited to, that the sidewalls of the main casing 2 to which the metal frames 300 are fixed are made of resin. The sidewalls of the main casing may be made of metal.

The above embodiment shows, but is not limited to, that the holder 100 has metal side plates 120. The holder may be all made of resin. The above embodiment shows, but is not limited to, that the holder 100 holds the photosensitive drums 61 positioned relative thereto. The holder may be configured to support the photosensitive drums in a state that there is slight play. In this case, the image forming apparatus may be desirably configured such that, when the holder is mounted to the main casing, the photosensitive drums are positioned relative to the main casing.

The above embodiment shows, but is not limited to, that the holder 100 is movable relative to the main casing 2 as a main body to the outside position where the developing cartridge 63 is replaced with a new one. The holder 100 may be removable from the main casing 2 in the outside position shown in FIG. 4A. Thus, by replacing the removed holder 100 with a new holder 100, the photosensitive drums 61 and chargers 62 held by the removed holder 100 can be easily replaced with new ones.

The above embodiment shows, but is not limited to, that the positioning hole 341 as the first positioning portion is located closer to the center of the main casing 2 in the front-rear direction than the positioning surface 352 as the second positioning portion. The first positioning portion may be located closer to the positioning hole 512 for positioning the exposure unit 5, which is shown in FIG. 9, in the front-rear direction, than the second positioning portion.

The above embodiment shows, but is not limited to, that the color laser printer 1 is configured to transfer toner images on the photosensitive drums 61 directly onto a sheet S conveyed by the conveyor belt 73. The color laser printer may be configured to transfer toner images from the photosensitive drums to an intermediate transfer belt and then transfer the toner image from the intermediate transfer belt to a sheet. The above embodiment shows, but is not limited to, the color laser printer 1 as an electrophotographic image forming apparatus according to aspects of the disclosure. The image forming apparatus may include a copier including a document reader such as a flatbed scanner, a multifunction apparatus and other apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body including a metal frame; and a holder configured to hold a plurality of photosensitive drums arranged in an arrangement direction, the holder being configured to move in the arrangement direction and be mounted in the main body, wherein, when the holder is mounted in the main body, the metal frame is disposed outside the holder, wherein the metal frame includes a main body portion extending in the arrangement direction and being disposed in a position not overlapping the photosensitive drums in an axial direction of the photosensitive drums, the main body portion further having a first end portion and a second end portion opposite to the first end portion in the arrangement direction, a first extension portion extending from the first end portion of the main body portion in a direction perpendicular to the arrangement direction and parallel to a side of the holder in a first dimension, the side of the holder being parallel to the arrangement direction in a second dimension, and a second extension portion extending from the second end portion of the main body portion in the direction perpendicular to the arrangement direction and parallel to the side of the holder in the first dimension, and wherein the first extension portion includes a first positioning portion configured to receive a coupling member that is configured to contact the holder to position the holder in the arrangement direction and in the direction perpendicular to the arrangement direction and parallel to the side of the holder in the first dimension, and the second extension portion includes a second positioning portion configured to receive the holder to position the holder in the direction perpendicular to the arrangement direction and parallel to the side of the holder in the first dimension, and wherein the first extension portion and the second extension portion together with the main body portion form a U-shaped structure.

2. The image forming apparatus according to claim 1, wherein the metal frame has a first frame including the main body portion and the first extension portion, and a second frame provided separately from the first frame and including at least the second extension portion.

3. The image forming apparatus according to claim 2, wherein the first frame has a first through hole and the second frame has a second through hole, wherein the main body includes a protrusion, wherein the first through hole and the second through hole are engaged with the protrusion such that the first frame and the second frame are positioned relative to the main body in at least the direction perpendicular to the arrangement direction and parallel to the side of the holder in the first dimension, and wherein at least the first through hole provided in the first frame is elongated in the arrangement direction.

4. The image forming apparatus according to claim 1, further comprising a light exposure unit configured to expose the photosensitive drums to light, the light exposure unit being supported by the main body portion of the metal frame.

5. The image forming apparatus according to claim 4, wherein the main body further includes an opposite frame disposed across the holder from the metal frame when the holder is mounted in the main body, wherein the image forming apparatus further comprises a support frame coupling the main body portion of the metal frame and the opposite frame, and wherein the light exposure unit is supported by the support frame.

6. The image forming apparatus according to claim 5, wherein the support frame is disposed between the light exposure unit and the photosensitive drums when the holder is mounted in the main body and includes a plate-like portion coupling the main body portion of the metal frame and the opposite frame, and wherein the plate-like portion is provided with a plurality of slit-like openings each allowing light emitted from the light exposure unit to pass through.

7. The image forming apparatus according to claim 1, further comprising a light exposure unit supported by the main body portion of the metal frame and configured to expose the photosensitive drums to light, wherein the metal frame includes a first frame including the main body portion and the first extension portion including the first positioning portion, and a second frame provided separately from the first frame and including at least the second extension portion including the second positioning portion.

8. The image forming apparatus according to claim 1, wherein the main body further includes a resin sidewall disposed outside the holder mounted in the main body in the axial direction and having a size greater than the metal frame as viewed in the axial direction, and wherein the metal frame is fixed to the resin sidewall.

9. The image forming apparatus according to claim 8, wherein the holder includes an engaging portion configured to engage the coupling member, and holds the plurality of photosensitive drums positioned relative to each other such that the plurality of photosensitive drums are configured to rotate.

10. The image forming apparatus according to claim 9, wherein the holder includes a pair of metal side plates disposed on opposite sides of the photosensitive drums in the axial direction and holding the plurality of photosensitive drums such that the plurality of photosensitive drums are positioned relative to each other and configured to rotate.

11. The image forming apparatus according to claim 1, wherein the main body further includes an opposite frame disposed across the holder from the metal frame when the holder is mounted in the main body and the coupling member coupling the first positioning portion of the first extension portion and the opposite frame, and wherein, when the holder is mounted in the main body, the holder contacts the coupling member.

12. The image forming apparatus according to claim 1, wherein the first positioning portion is located closer to a center of the main body in the arrangement direction than the second positioning portion.

13. An image forming apparatus comprising:

a main body including a metal frame; and a holder configured to hold a plurality of photosensitive drums arranged in an arrangement direction, the holder being configured to move in the arrangement direction and be mounted in the main body, wherein, when the holder is mounted in the main body, the metal frame is disposed outside the holder, wherein the metal frame includes a main body portion extending in the arrangement direction and being disposed in a position not overlapping the photosensitive drums in an axial direction of the photosensitive drums, the main body portion further having a first end portion and a second end portion opposite to the first end portion in the arrangement direction, a first extension portion extending from the first end portion of the main body portion in a direction perpendicular to the arrangement direction and parallel to a side of the holder, and a second extension portion extending from the second end portion of the main body portion in the direction perpendicular to the arrangement direction and parallel to the side of the holder, and wherein the first extension portion includes a first positioning portion configured to receive a coupling member that is configured to contact the holder to position the holder in the arrangement direction and in the direction perpendicular to the arrangement direction and parallel to the side of the holder, and the second extension portion includes a second positioning portion configured to receive the holder to position the holder in the direction perpendicular to the arrangement direction and parallel to the side of the holder, wherein the metal frame has a first frame including the main body portion and the first extension portion, and a second frame provided separately from the first frame and including at least the second extension portion, wherein the first frame has a first through hole and the second frame has a second through hole, wherein the main body includes a protrusion, wherein the first through hole and the second through hole are engaged with the protrusion such that the first frame and the second frame are positioned relative to the main body in at least the direction perpendicular to the arrangement direction and parallel to the side of the holder, and wherein at least the first through hole provided in the first frame is elongated in the arrangement direction.

14. The image forming apparatus according to claim 13, further comprising a light exposure unit configured to expose the photosensitive drums to light, the light exposure unit being supported by the main body portion of the metal frame.

15. The image forming apparatus according to claim 14, wherein the main body further includes an opposite frame disposed across the holder from the metal frame when the holder is mounted in the main body, wherein the image forming apparatus further comprises a support frame coupling the main body portion of the metal frame and the opposite frame, and wherein the light exposure unit is supported by the support frame.

16. The image forming apparatus according to claim 13, further comprising a light exposure unit supported by the main body portion of the metal frame and configured to expose the photosensitive drums to light.

17. The image forming apparatus according to claim 13, wherein the main body further includes a resin sidewall disposed outside the holder mounted in the main body in the axial direction and having a size greater than the metal frame as viewed in the axial direction, and wherein the metal frame is fixed to the resin sidewall.

18. The image forming apparatus according to claim 17, wherein the holder includes an engaging portion configured to engage the coupling member, and holds the plurality of photosensitive drums positioned relative to each other such that the plurality of photosensitive drums are configured to rotate.

19. The image forming apparatus according to claim 18, wherein the holder includes a pair of metal side plates disposed on opposite sides of the photosensitive drums in the axial direction and holding the plurality of photosensitive drums such that the plurality of photosensitive drums are positioned relative to each other and configured to rotate.

20. The image forming apparatus according to claim 13, wherein the main body further includes an opposite frame disposed across the holder from the metal frame when the holder is mounted in the main body and the coupling member coupling the first positioning portion of the first extension portion and the opposite frame, and wherein, when the holder is mounted in the main body, the holder contacts the coupling member.

* * * * *